US007843419B2

(12) United States Patent
Chen et al.

(10) Patent No.: US 7,843,419 B2
(45) Date of Patent: Nov. 30, 2010

(54) TRANSFLECTIVE LCD AND DRIVING METHOD THEREOF

(75) Inventors: Po-Yang Chen, Tao-Yuan Hsien (TW); Po-Sheng Shih, Tao-Yuan Hsien (TW)

(73) Assignee: Hannstar Display Corporation, Tao-Yuan Hsien (TW)

( * ) Notice: Subject to any disclaimer, the term of this patent is extended or adjusted under 35 U.S.C. 154(b) by 1048 days.

(21) Appl. No.: 11/560,995

(22) Filed: Nov. 17, 2006

(65) Prior Publication Data

US 2008/0117156 A1 May 22, 2008

(51) Int. Cl.
*G09G 3/36* (2006.01)

(52) U.S. Cl. ..... 345/92; 345/94; 345/95

(58) Field of Classification Search ..... 345/92, 345/94, 95, 204, 210, 691, 693
See application file for complete search history.

(56) References Cited

U.S. PATENT DOCUMENTS 6,456,268 B1 * 9/2002 Takeda ..... 345/92
2003/0160244 A1 * 8/2003 Amano et al. ..... 257/72
2005/0018113 A1 * 1/2005 Shen et al. ..... 349/114
2006/0274008 A1 * 12/2006 Lin et al. ..... 345/92
2007/0046606 A1 * 3/2007 Kim et al. ..... 345/90
2007/0120797 A1 * 5/2007 Lin et al. ..... 345/92
2007/0126952 A1 * 6/2007 Yan ..... 349/106
2007/0153171 A1 * 7/2007 Kim ..... 349/114
2007/0171339 A1 * 7/2007 Su et al. ..... 349/114
2007/0216821 A1 * 9/2007 Kim et al. ..... 349/38

* cited by examiner

*Primary Examiner*—Amare Mengistu
*Assistant Examiner*—Premal Patel
(74) *Attorney, Agent, or Firm*—Thomas, Kayden, Horstemeyer & Risley, LLP

(57) ABSTRACT

The present invention provides a transflective LCD including a plurality of pixel units defined by scan lines and data lines. Each pixel unit includes two sub-pixels. Each sub-pixel includes a storage capacitor. The two storage capacitors are connected to different voltage sources and correspond to a reflection region and a transmission region in a pixel unit respectively to modify the pixel voltage.

7 Claims, 11 Drawing Sheets

TRANSFLECTIVE LCD AND DRIVING METHOD THEREOF

FIELD OF THE INVENTION

The present invention relates to a LCD, and more particularly to a transflective Liquid Crystal Display with an improved view angle.

BACKGROUND OF THE INVENTION

Typically, there are three Liquid Crystal Display (LCD) display methods: transmissive, reflective and transflective.

In transmissive LCD a backlight module transmits light through the panel to display the images. In other words, this type of LCD uses its own light source to provide light. Therefore, when the ambient light is brighter than the light provided by the backlight module, the display image is not clear.

In a reflective type LCD, a reflective film is coated on the down glass substrate of the panel to reflect environmental light. The ambient light is used as a light source. Therefore, when the ambient light is dim, the display image is not clear.

A transflective type LCD is developed to resolve the above problems. The transflective type LCD has both transmissive type and reflective type characteristics. When the ambient light is strong, the transflective type LCD acts as a reflective type LCD and uses the ambient light to display image. When the ambient light is weak, the transflective type LCD acts as a transmissive type LCD and uses the backlight module to provide light to display the image. Therefore, this transflective type LCD may be used in conditions with different ambient light.

However, different cell gaps have to be formed in a transflective type LCD to make the reflective region and the transmissive region have the same optical characteristic. In other words, the cell gap in the reflective region is half of the cell gap in the transmissive region. This process for forming different cell gaps is very difficult and easily to reduces the yield.

Therefore, a transflective type LCD that may resolve the above problems is required.

SUMMARY OF THE INVENTION

The main purpose of the present invention is to provide a transflective LCD with a single cell gap.

The purpose of the present invention is to provide a pixel unit that may generate two different T-V characteristics respectively corresponding to the reflective region and the transmissive region to improve the optical characteristics.

The purpose of the present invention is to provide a pixel unit that is divided into two sub-pixels respectively corresponding to the reflective region and the transmissive region. The two sub-pixels may generate different pixel voltages to improve the optical characteristic.

The purpose of the present invention is to provide a drive method to drive a pixel unit that is divided into two sub-pixels.

The purpose of the present invention is to provide a drive method to drive a pixel unit that is divided into two sub-pixels. This drive method may drive the two sub-pixels to generate different pixel voltages to improve the optical characteristic.

Accordingly, the present invention provides a transflective LCD comprising: a plurality of scan lines; a plurality of data lines crossing the scan lines; a plurality of common electrode lines, wherein the common electrode lines and the scan lines are alternatively arranged and the adjacent data lines and scan lines define a pixel unit and each pixel unit includes a first sub-pixel located in a corresponding reflective region and a second sub-pixel electrode located in a corresponding transmissive region. Each sub-pixel includes a transistor and a storage capacitor coupled with the transistor. The pixel electrodes are coupled to a first voltage source and a second voltage source through the two storage capacitors respectively to modify the pixel electrode voltage. Such modification may make the transmissive region and the reflective region have different pixel electrode voltages.

According to an embodiment, the first voltage source is the scanning line and the second voltage source is the common electrode.

According to an embodiment, the first sub-pixel and the second sub-pixel are located in the two sides of a corresponding data line.

According to an embodiment, the first sub-pixel and the second sub-pixel are located in one side of a corresponding data line.

According to the above purposes, the present invention provides a transflective LCD comprising: a plurality of scan lines; a plurality of data lines crossing the scan lines; a plurality of common electrode lines, wherein the common electrode lines and the scan lines are alternatively arranged and the adjacent data lines and scan lines define a pixel unit and each pixel unit includes a first sub-pixel located in a corresponding reflective region and a second sub-pixel electrode located in a corresponding transmissive region. Each sub-pixel includes a transistor, a pixel electrode electrically coupled with the transistor and a storage capacitor coupled with the pixel electrode. The two storage capacitors of two sub-pixels respectively have different capacitance and are coupled to same voltage source to modify the pixel electrode voltage. Such modifications may make the transmissive region and the reflective region have different pixel electrode voltage.

According to an embodiment, the voltage source is the scanning line.

According to an embodiment, the first sub-pixel and the second sub-pixel are located in the two sides of a corresponding data line.

According to an embodiment, the first sub-pixel and the second sub-pixel are located in one side of a corresponding data line.

According to the above purposes, the present invention provides a drive method to drive a pixel unit, wherein a first scanning line and a second scanning line define the pixel unit that includes a first sub-pixel and a second sub-pixel, the first sub-pixel includes a first transistor, a first pixel electrode and a first storage capacitor, the second sub-pixel includes a second transistor, a second pixel electrode and a second storage capacitor, and the first sub-pixel located in a reflective region of the pixel unit and the second sub-pixel located in a transmissive region of the pixel unit, comprising: providing a high level electric potential to the second scanning line to turn on the first transistor and the second transistor to write a data signal transferred in a data line to the first storage capacitor to form a first pixel electrode voltage and to write the data signal to the second storage capacitor to form a second pixel electrode voltage; and providing a low level electric potential to the second scanning line to turn off the first transistor and the second transistor and change the first scanning line's electrical potential to change the first pixel electrode voltage through the first storage capacitor and to change the second pixel electrode voltage through second storage capacitor.

According to an embodiment, the high level electric potential is the first electric potential, the low level electric potential is the third electric potential, and changing the electrical potential of the first scanning line from a second electric potential to a third electrical potential, wherein the first electric potential is larger than the second electric potential and the second electric potential is larger than the third electric potential.

According to an embodiment, the high level electric potential is the first electric potential, the low level electric potential is the second electric potential, and changing the electrical potential of the first scanning line from a fourth electric potential to a third electrical potential, wherein the first electric potential is larger than the second electric potential and the second electric potential is larger than the third electric potential and the third electric potential is larger than the fourth electric potential.

According to an embodiment, the high level electric potential is the first electric potential, the low level electric potential is the fourth electric potential, and changing the electrical potential of the first scanning line from a second electric potential to a third electrical potential, wherein the first electric potential is larger than the second electric potential and the second electric potential is larger than the third electric potential and the third electric potential is larger than the fourth electric potential.

According to an embodiment, the second storage capacitor is coupled to a fixed voltage source.

According to an embodiment, the second storage capacitor is coupled to the first scanning line.

Accordingly, a pixel unit in the present invention is divided into two sub-pixels that respectively correspond to a transmissive region and a reflective region of the pixel unit. Each sub-pixel includes a thin film transistor, a liquid crystal capacitor and a storage capacitor. The two sub-pixels generate different Gamma characteristic curves to respectively correspond to the transmissive region and the reflective region. The different Gamma characteristic curves make the transmissive region and the reflective region of the pixel unit have same optics characteristics. Accordingly, the transmissive region and the reflective region of a pixel unit have same cell gap. Therefore, the process is easy.

BRIEF DESCRIPTION OF THE DRAWINGS

The foregoing aspects and many of the attendant advantages of this invention are more readily appreciated and better understood by referencing the following detailed description, when taken in conjunction with the accompanying drawings, wherein.

DETAILED DESCRIPTION OF THE PREFERRED EMBODIMENT

A pixel is divided into two sub-pixels to generate different Gamma characteristic curve respectively in the present invention. Each sub-pixel has a thin film transistor, a liquid crystal capacitor and a storage capacitor. The two sub pixels respectively correspond to the transmissive region and the reflective region in a transflective type LCD. The following embodiments are used to describe the present invention.

Figure 1A:
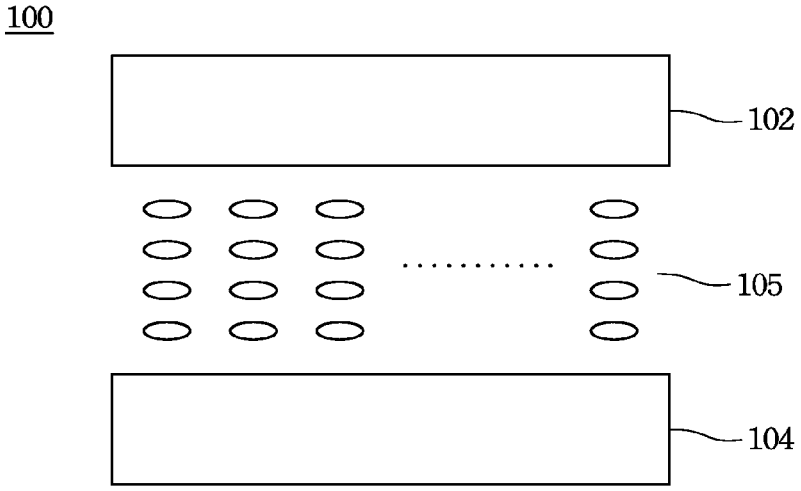
FIG. 1A is a schematic diagram of LCD according to present invention.
Figure 1B:
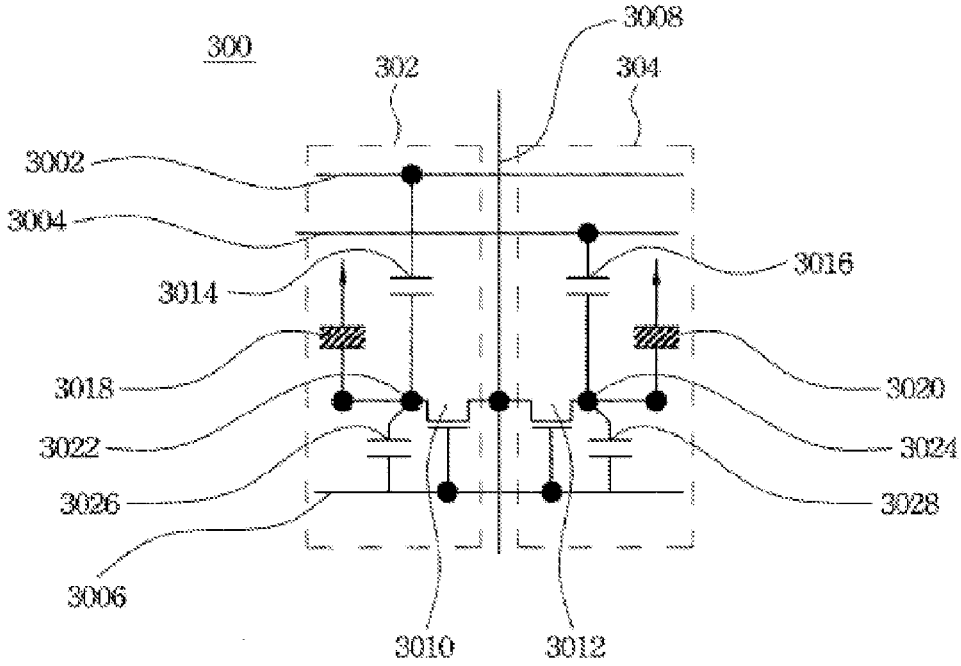
FIG. 1B illustrates a schematic diagram of a pixel unit according to the first embodiment of the present invention.

FIG. 1A is a schematic diagram of LCD according to present invention. This LCD 100 comprises an upper substrate 102, a lower substrate 104 and a liquid crystal molecule layer 105 disposed between the upper substrate 102 and the lower substrate 104. A plurality of color filter layers and a common electrode are formed on the upper substrate 102. A plurality of scan lines and a plurality of data lines are formed on the lower substrate 104. A thickness of the liquid crystal molecule layer 105 over the transmissive regions and a thickness of the liquid crystal molecule layer 105 over the reflective regions are substantially the same. FIG. 1B is a schematic diagram of a pixel unit according to the first embodiment of the present invention. The scan lines perpendicularly cross through the data lines. Two adjacent scan lines and two adjacent data lines define a pixel unit 300. The pixel unit 300 includes two sub-pixels 302 and 304. The sub-pixel 302 is located in the reflective region of the pixel unit 300. The sub-pixel 304 is located in the transmissive region of the pixel unit 300.

The sub-pixel 302 includes a thin film transistor 3010. According to the thin film transistor 3010, the gate electrode is connected to the scanning line 3006, the drain electrode is connected to the data line 3008 and the source electrode is connected to the pixel electrode 3022. The storage capacitor 3014 is composed of the pixel electrode 3022 and the scanning line 3002. The pixel electrode 3022 partially overlaps the scanning line 3002. The liquid crystal capacitor 3018 is composed of the pixel electrode 3022 and the conductive electrode in the upper substrate (not shown in figure). A parasitical capacitor 3026 exists between the gate and the source electrode of the thin film transistor 3010.

The sub-pixel 304 includes a thin film transistor 3012. According to the thin film transistor 3012, the gate electrode is connected to the scanning line 3006, the drain electrode is connected to the data line 3008 and the source electrode is connected to the pixel electrode 3024. The storage capacitor 3016 is composed of the pixel electrode 3024 and the common electrode line 3004. The pixel electrode 3024 partially overlaps the common electrode line 3004. The liquid crystal capacitor 3020 is composed of the pixel electrode 3024 and the conductive electrode on the upper substrate (not shown in figure). A parasitical capacitor 3028 exists between the gate and the source electrode of the thin film transistor 3012. According to this embodiment, the gate electrodes of the thin film transistors 3010 and 3012 are connected to the scanning line 3006. The drain electrodes of the thin film transistors 3010 and 3012 are connected to the data line 3008. Therefore, the two thin film transistors 3010 and 3012 are connected in parallel. In other words, the pixel electrodes 3022 and 3024 are not in the floating state. The charge aggregation phenomenon and the electric potential shift phenomenon do not happen. Moreover, only the scanning line 3002 and 3006, data line 3008 and the common electrode line 3004 are required in this embodiment. The common electrode line is connected to a voltage source. It is not necessary to add the additional scanning line or voltage source in this embodiment. Moreover, the cell gap corresponding to the sub-pixel 302 and the cell gap corresponding to the sub-pixel 304 are substantially same.

Figure 2:
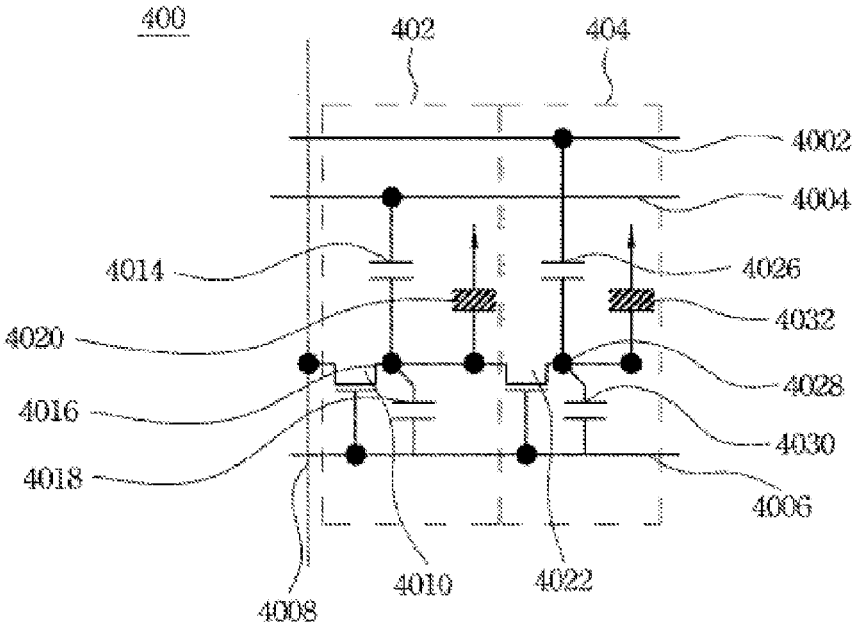
FIG. 2 illustrates a schematic diagram of a pixel unit according to the second embodiment of the present invention.

FIG. 2 is a schematic diagram of a pixel unit according to the second embodiment of the present invention. The pixel unit 400 includes two sub-pixels 402 and 404. The sub-pixel 404 is located in the reflective region of the pixel unit 400. The sub-pixel 402 is located in the transmissive region of the pixel unit 400.

The pixel unit 400 includes two sub-pixels 402 and 404. The sub-pixel 402 includes a thin film transistor 4010. According to the thin film transistor 4010, the gate electrode is connected to the scanning line 4006, the drain electrode is connected to the data line 4008 and the source electrode is connected to the pixel electrode 4016. The storage capacitor 4014 is composed of the pixel electrode 4016 and the common electrode line 4004. The liquid crystal capacitor 4020 is composed of the pixel electrode 4016 and the conductive electrode on the upper substrate (not shown in figure). The source electrode of the thin film transistor 4010 is connected to the drain electrode of the thin film transistor 4022. A parasitical capacitor 4018 exists between the connection point and the gate of the thin film transistor 4010.

The sub-pixel 404 includes a thin film transistor 4022. According to the thin film transistor 4022, the gate electrode is connected to the scanning line 4006, the drain electrode is connected to the source electrode of the thin film transistor 4010 and the source electrode is connected to the pixel electrode 4028. The storage capacitor 4026 is composed of the pixel electrode 4028 and the scanning line 4002. The liquid crystal capacitor 4032 is composed of the pixel electrode 4028 and the conductive electrode on the upper substrate (not shown in figure). A parasitical capacitor 4030 exists between the gate and the source electrode of the thin film transistor 4022. According to this embodiment, the source electrode of the thin film transistor 4010 is connected to the drain electrode of the thin film transistor 4022. Therefore, the two thin film transistors 4010 and 4022 are connected in series. In other words, the pixel electrodes 4016 and 4028 are not in the floating state. The charge aggregation phenomenon and the electric potential shift phenomenon do not happen. Moreover, only the scanning line 4002 and 4006, data line 4008 and the common electrode line 4004 are required in this embodiment. The common electrode line is connected to a voltage source. It is not necessary to increase the additional scanning line or data line in this embodiment. Moreover, the cell gap corresponding to the sub-pixel 402 and the cell gap corresponding to the sub-pixel 404 are substantially same.

Figure 3:
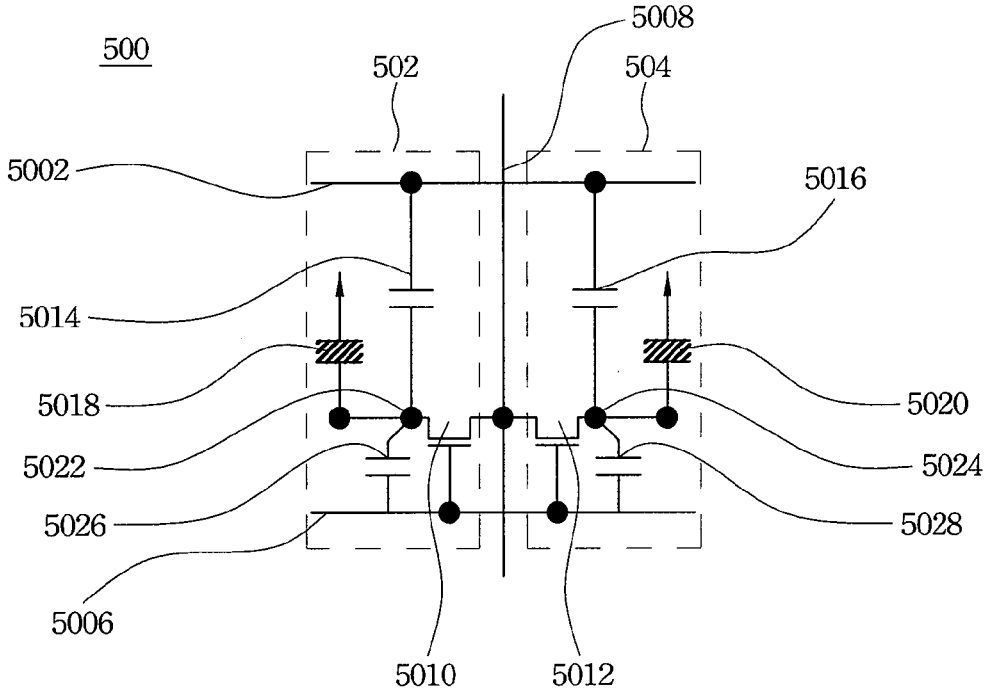
FIG. 3 illustrates a schematic diagram of a pixel unit according to the third embodiment of the present invention.

FIG. 3 is a schematic diagram of a pixel unit according to the third embodiment of the present invention. The pixel unit 500 includes two sub-pixels 502 and 504. The sub-pixel 502 is located in the reflective region of the pixel unit 500. The sub-pixel 504 is located in the transmissive region of the pixel unit 500.

The pixel unit 500 includes two sub-pixels 502 and 504. The sub-pixel 502 includes a thin film transistor 5010. According to the thin film transistor 5010, the gate electrode is connected to the scanning line 5006, the drain electrode is connected to the data line 5008 and the source electrode is connected to the pixel electrode 5022. The storage capacitor 5014 is composed of the pixel electrode 5022 and the scanning line 5002. The liquid crystal capacitor 5018 is composed of the pixel electrode 5022 and the conductive electrode on the upper substrate (not shown in figure). A parasitical capacitor 5026 exists between the source electrode and the gate of the thin film transistor 5010.

The sub-pixel 504 includes a thin film transistor 5012. According to the thin film transistor 5012, the gate electrode is connected to the scanning line 5006, the drain electrode is connected to the data line 5008 and the source electrode is connected to the pixel electrode 5024. The storage capacitor 5016 is composed of the pixel electrode 5024 and the scanning line 5002. The liquid crystal capacitor 5020 is composed of the pixel electrode 5024 and the conductive electrode on the upper substrate (not shown in figure). A parasitical capacitor 5028 exists between the gate and the source electrode of the thin film transistor 5012. According to this embodiment, the gate electrodes of the thin film transistors 5010 and 5012 are connected to the scanning line 5006. The drain electrodes of the thin film transistors 5010 and 5012 are connected to the data line 5008. Therefore, the two thin film transistors 5010 and 5012 are connected in parallel. In other words, the pixel electrodes 5022 and 5024 are not in the floating state. The charge aggregation phenomenon and the electric potential shift phenomenon do not happen. Moreover, only the scanning line 5002 and 5006, data line 5008 are required in this embodiment. It is not necessary to increase the additional scanning line or data line in this embodiment.

According to this embodiment, the storage capacitor 5014 is composed of the pixel electrode 5022 and the scanning line 5002. The storage capacitor 5016 is composed of the pixel electrode 5024 and the scanning line 5002. Therefore, the electric potential of the pixel electrodes 5022 and 5024 are separated by modifying the capacitance of the storage capacitor 5014 and 5016 and by a driving wave and the coupling effect of the storage capacitor 5014 and 5016. Moreover, the output range of the electric potential in the data line is reduced, which also reduces the power consumption. On the other hand, the cell gap corresponding to the sub-pixel 502 and the cell gap corresponding to the sub-pixel 504 are substantially same.

Figure 4:
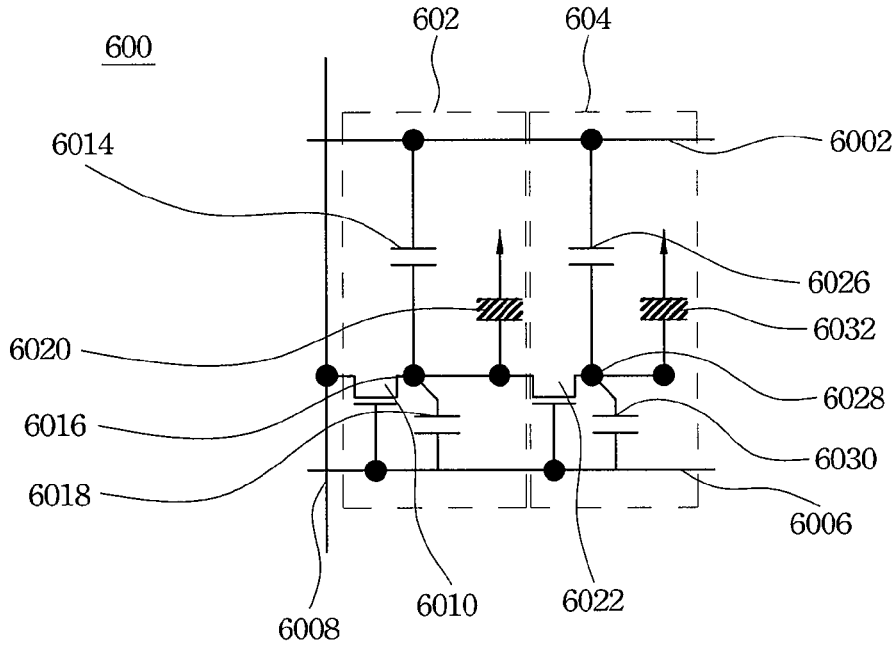
FIG. 4 illustrates a schematic diagram of a pixel unit according to the fourth embodiment of the present invention.

FIG. 4 is a schematic diagram of a pixel unit according to the fourth embodiment of the present invention. The pixel unit 600 includes two sub-pixels 602 and 604. The sub-pixel 602 is located in the transmissive region of the pixel unit 600. The sub-pixel 604 is located in the reflective region of the pixel unit 600.

The pixel unit 600 includes two sub-pixels 602 and 604. The sub-pixel 602 includes a thin film transistor 6010. According to the thin film transistor 6010, the gate electrode is connected to the scanning line 6006, the drain electrode is connected to the data line 6008 and the source electrode is connected to the pixel electrode 6016. The storage capacitor 6014 is composed of the pixel electrode 6016 and the scanning line 6002. The liquid crystal capacitor 6020 is composed of the pixel electrode 6016 and the conductive electrode on the upper substrate (not shown in figure). The source electrode of the thin film transistor 6010 is connected to the drain electrode of the thin film transistor 6022. A parasitical capacitor 6018 exists between the connection point and the gate of the thin film transistor 6010.

The sub-pixel 604 includes a thin film transistor 6022. According to the thin film transistor 6022, the gate electrode is connected to the scanning line 6006, the drain electrode is connected to the source electrode of the thin film transistor 6010 and the source electrode is connected to the pixel electrode 6028. The storage capacitor 6026 is composed of the pixel electrode 6028 and the scanning line 6002. The liquid crystal capacitor 6032 is composed of the pixel electrode 6028 and the conductive electrode on the upper substrate (not shown in figure). A parasitical capacitor 6030 exists between the gate and the source electrode of the thin film transistor 6022. According to this embodiment, the source electrode of the thin film transistor 6010 is connected to the drain electrode of the thin film transistor 6022. Therefore, the two thin film transistors 6010 and 6022 are connected in series. In other words, the pixel electrodes 6016 and 6028 are not in the floating state. The charge aggregation phenomenon and the electric potential shift phenomenon do not happen. Moreover, only the scanning lines 6002 and 6006 and the data line 6008 are required in this embodiment. It is not necessary to increase the additional scanning line or data line in this embodiment.

According to this embodiment, the storage capacitor 6014 is composed of the pixel electrode 6016 and the scanning line 6002. The storage capacitor 6026 is composed of the pixel electrode 6028 and the scanning line 6002. Therefore, the electric potentials of the pixel electrodes 6016 and 6028 are separated by modifying the capacitance of the storage capacitor 6014 and 6026 and by a driving wave and the coupling effect of the storage capacitor 6014 and 6026. Moreover, the output range of the electric potential in the data line is reduced, which also reduces the power consumption. On the other hand, the cell gap corresponding to the sub-pixel 602 and the cell gap corresponding to the sub-pixel 604 are substantially same.

Figure 5:
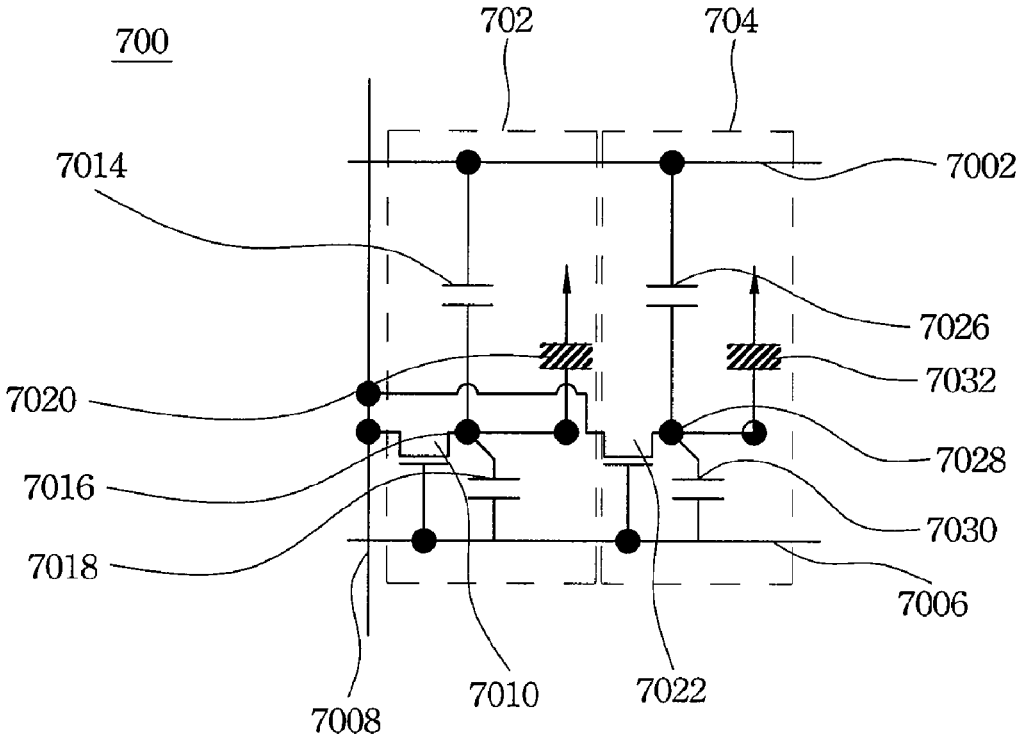
FIG. 5 illustrates a schematic diagram of a pixel unit according to the fifth embodiment of the present invention.

FIG. 5 is a schematic diagram of a pixel unit according to the fifth embodiment of the present invention. The pixel unit 700 includes two sub-pixels 702 and 704. The sub-pixel 702 is located in the transmissive region of the pixel unit 700. The sub-pixel 704 is located in the reflective region of the pixel unit 700.

The pixel unit 700 includes two sub-pixels 702 and 704. The sub-pixel 702 includes a thin film transistor 7010. According to the thin film transistor 7010, the gate electrode is connected to the scanning line 7006, the drain electrode is connected to the data line 7008 and the source electrode is connected to the pixel electrode 7016. The storage capacitor 7014 is composed of the pixel electrode 7016 and the bias line 7002. The liquid crystal capacitor 7020 is composed of the pixel electrode 7016 and the conductive electrode on the upper substrate (not shown in figure). A parasitical capacitor 7018 exists between the connection point and the gate of the thin film transistor 7010.

The sub-pixel 704 includes a thin film transistor 7022. According to the thin film transistor 7022, the gate electrode is connected to the scanning line 7006, the drain electrode is connected to the data line 7008 and the source electrode is connected to the pixel electrode 7028. The storage capacitor 7026 is composed of the pixel electrode 7028 and the bias line 7002. The liquid crystal capacitor 7032 is composed of the pixel electrode 7028 and the conductive electrode on the upper substrate (not shown in figure). A parasitical capacitor 7030 exists between the gate and the source electrode of the thin film transistor 7022. According to this embodiment, the pixel electrodes 7016 and 7028 are connected to the thin film transistors 7010 and 7022 respectively. Therefore, the pixel electrodes 7016 and 7028 are not in the floating state. The charge aggregation phenomenon and the electric potential shift phenomenon do not happen. Moreover, the cell gap corresponding to the sub-pixel 702 and the cell gap corresponding to the sub-pixel 704 are substantially same.

Figure 6:
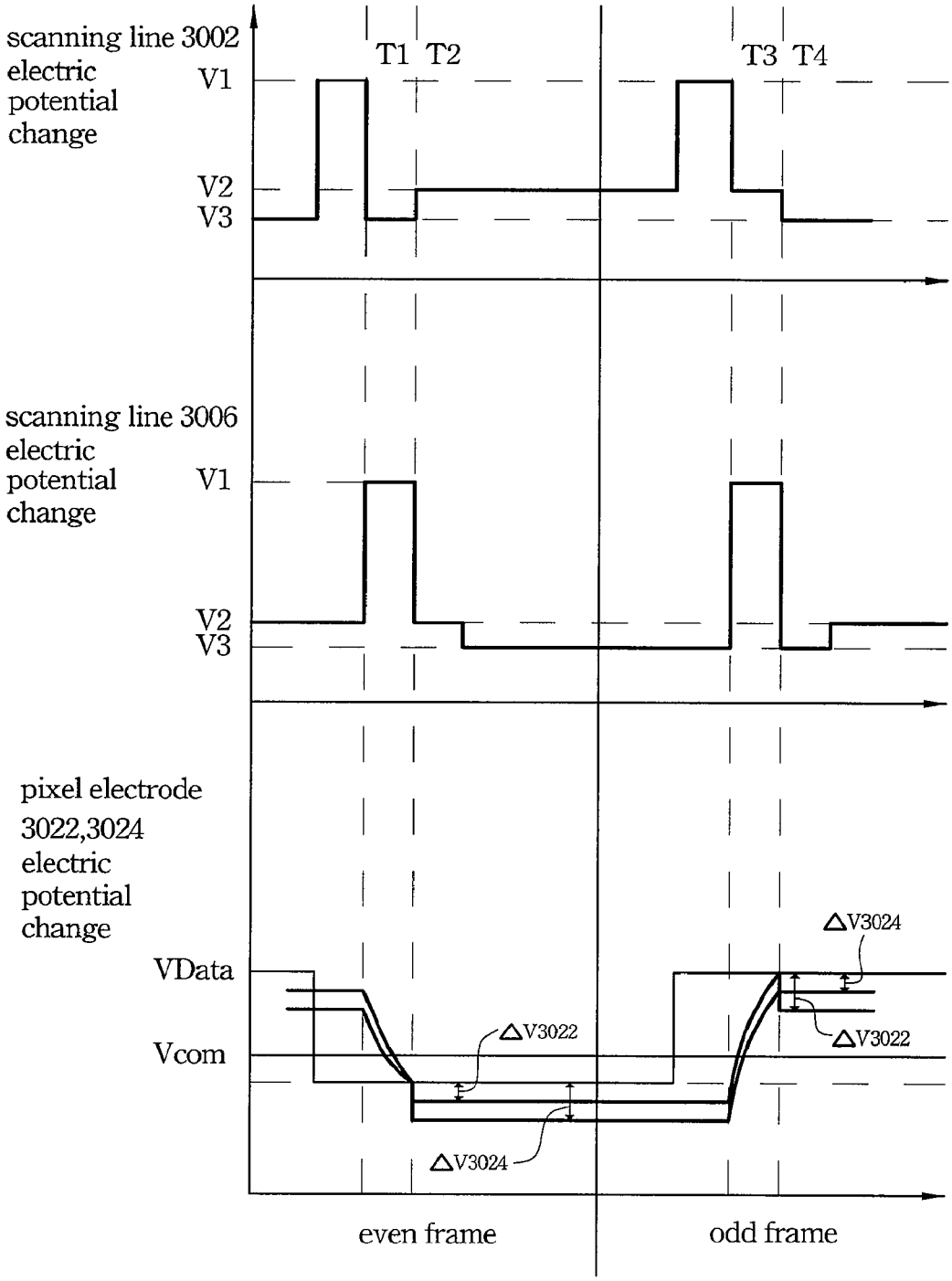
FIG. 6 illustrates the three-level drive waveform and the electric potential change of pixel electrodes according to an embodiment of the present invention.

FIG. 6 illustrates the three-level drive waveform and the electric potential change of pixel electrodes according to an embodiment of the present invention. Please refer to FIG. 6 and FIGS. 1A and 1B together. In this embodiment, the drive waveform includes three electric potentials, V1, V2 and V3. The relationship among the three electric potentials is V1>V2>V3. The left part of FIG. 6 illustrates the corresponding waveform in the even frame. The right part of FIG. 6 illustrates the corresponding waveform in the odd frame.

During the time segment T1 of the even frame, the scanning line 3006 is selected. At this time, data with negative polarity is transferred in the data line 3008. The electric potential of the gate electrodes of the thin film transistors 3010 and 3012 is increased to V1 to turn on thin film transistors 3010 and 3012. The data in the data line 3008 is transferred to the pixel electrode 3022 through the thin film transistor 3010. The data in the data line 3008 is transferred to the pixel electrode 3024 through the thin film transistor 3012. When time segment T1 is almost over, the pixel electrodes 3022 and 3024 have the same electric potential. During the time segment T2, the electric potential on the scanning line 3006 is reduced to the electric potential V2 to turn off the thin film transistors 3010 and 3012. Therefore, the two pixel electrodes are isolated.

On the other hand, the scanning line 3006 is coupled to the pixel electrode 3022 and 3024 through the parasitical capacitors 3026 and 3028 respectively. Therefore, the electric potentials of the pixel electrodes 3022 and 3024 are affected by the electric potential variation (V1-V2) of the scanning line 3006 during the time segment T2.

Moreover, the scanning line 3002 is coupled to the pixel electrode 3022 through the storage capacitors 3014. Therefore, the electric potential of the pixel electrodes 3022 is also affected by the electric potential variation of the scanning line 3002. During the time segment T2, the electric potential of the scanning line 3002 is changed from V3 to V2. The increased electric potential variation (V2-V3) of the scanning line 3002 is coupled to the pixel electrode 3022 to reduce the absolute value of the electric potential of the pixel electrode 3022. Such variation separates the electric potential value between the pixel electrodes 3022 and 3024. By means of modifying the capacitances of the storage capacitors 3014 and 3016 to change the electric potential difference between the pixel electrodes 3022 and 3024, the transmission region and the reflective region have same optical characteristics ○ During the time segment T2, the electric potential variation of the pixel electrode 3024, ΔV(3024), is described in the following:

$$\Delta V(3024) = \frac{C_{gs}(3028)}{C_T(3024)}(V1 - V2), \text{ and}$$

$$C_T(3024) = C_{lc}(3020) + C_{st}(3016) + C_{gs}(3028)$$

The $C_T$ (3024) is the total capacitance related to the pixel electrode 3024. The $C_{lc}$ (3020) is the capacitance of the liquid crystal capacitor 3020. The $C_{st}$ (3016) is the capacitance of the storage capacitor 3016. The $C_{gs}$ (3028) is the capacitance of the parasitical capacitor 3028.

During the time segment T2, the electric potential variation of the pixel electrode 3022, ΔV(3022), is described in the following:

$$\Delta V(3022) = \left| \frac{C_{gs}(3026)}{C_T(3022)}(V1 - V2) - \frac{C_{st}(3014)}{C_T(3022)}(V2 - V3) \right|, \text{ and}$$

$$C_T(3022) = C_{lc}(3018) + C_{st}(3014) + C_{gs}(3026)$$

The $C_T$ (3022) is the total capacitance related to the pixel electrode 3022. The $C_{lc}$ (3018) is the capacitance of the liquid crystal capacitor 3018. The $C_{st}$ (3014) is the capacitance of the storage capacitor 3014. The $C_{gs}$ (3026) is the capacitance of the parasitical capacitor 3026.

Moreover, the $$\frac{C_{st}(3014)}{C_T(3022)}(V2 - V3)$$

is the electric potential variation value of the pixel electrode 3022 because of the coupling effect from the scanning line 3002.

In the odd frame, positive polarity data is transferred in the data line 3008. Please refer to the FIG. 6 and FIGS. 1A and 1B. The main difference between the odd frame and the even frame is described in the following. During the time segment T1 of the even frame, the three-level drive waveform for driving the scanning line 3002 is pulled down to the lowest electric potential V3. Then, during the time segment T2 of the even frame, the three-level drive waveform for driving the scanning line 3002 is pulled up to the electric potential V2. Such a drive waveform reduces the absolute value of the electric potential variation in the pixel electrode 3022.

However, the drive waveform in the odd frame is different from the drive waveform in the even frame. During the time segment T3 of the odd frame, the three-level drive waveform for driving the scanning line 3002 is pulled down to the electric potential V2. During the time segment T4 of the odd frame, the three-level drive waveform for driving the scanning line 3006 is pulled down to the lowest electric potential V3 to turn off the thin film transistor 3010 and 3012. Then, the three-level drive waveform for driving the scanning line 3002 is first pulled down to the lowest electric potential V3. Such a drive waveform increases the absolute value of the electric potential variation in the pixel electrode 3022.

During the time segment T4, the electric potential variation of the pixel electrode 3024, ΔV(3024), is described in the following:

$$\Delta V(3024) = \frac{C_{gs}(3028)}{C_T(3024)}(V1 - V3), \text{ and}$$

$$C_T(3024) = C_{lc}(3020) + C_{st}(3016) + C_{gs}(3028)$$

The $C_T$ (3024) is the total capacitance related to the pixel electrode 3024. The $C_{lc}$ (3020) is the capacitance of the liquid crystal capacitor 3020. The $C_{st}$ (3016) is the capacitance of the storage capacitor 3016. The $C_{gs}$ (3028) is the capacitance of the parasitical capacitor 3028.

During the time segment T4, the electric potential variation of the pixel electrode 3022, ΔV(3022), is described in the following:

$$\Delta V(3022) = \frac{C_{gs}(3026)}{C_T(3022)}(V1 - V3) + \frac{C_{st}(3014)}{C_T(3022)}(V2 - V3), \text{ and}$$

$$C_T(3022) = C_{lc}(3018) + C_{st}(3014) + C_{gs}(3026)$$

The $C_T$ (3022) is the total capacitance related to the pixel electrode 3022. The $C_{lc}$ (3018) is the capacitance of the liquid crystal capacitor 3018. The $C_{st}$ (3014) is the capacitance of the storage capacitor 3014. The $C_{gs}$ (3026) is the capacitance of the parasitical capacitor 3026. Therefore, the electric potentials of the pixel electrodes 3022 and 3024 are separated to make the transmissive region and the reflective region of the pixel unit have same optics characteristic.

The foregoing application of the drive waveform illustrated in FIG. 6 is based on the pixel unit 300 of the first embodiment in FIGS. 1A and 1B. However, it is noticed that the drive waveform illustrated in FIG. 6 also is used in the pixel unit 400 of the second embodiment in FIG. 2, in the pixel unit 500 of the third embodiment in FIG. 3 and in the pixel unit 600 of the fourth embodiment in FIG. 4.

Figure 7:
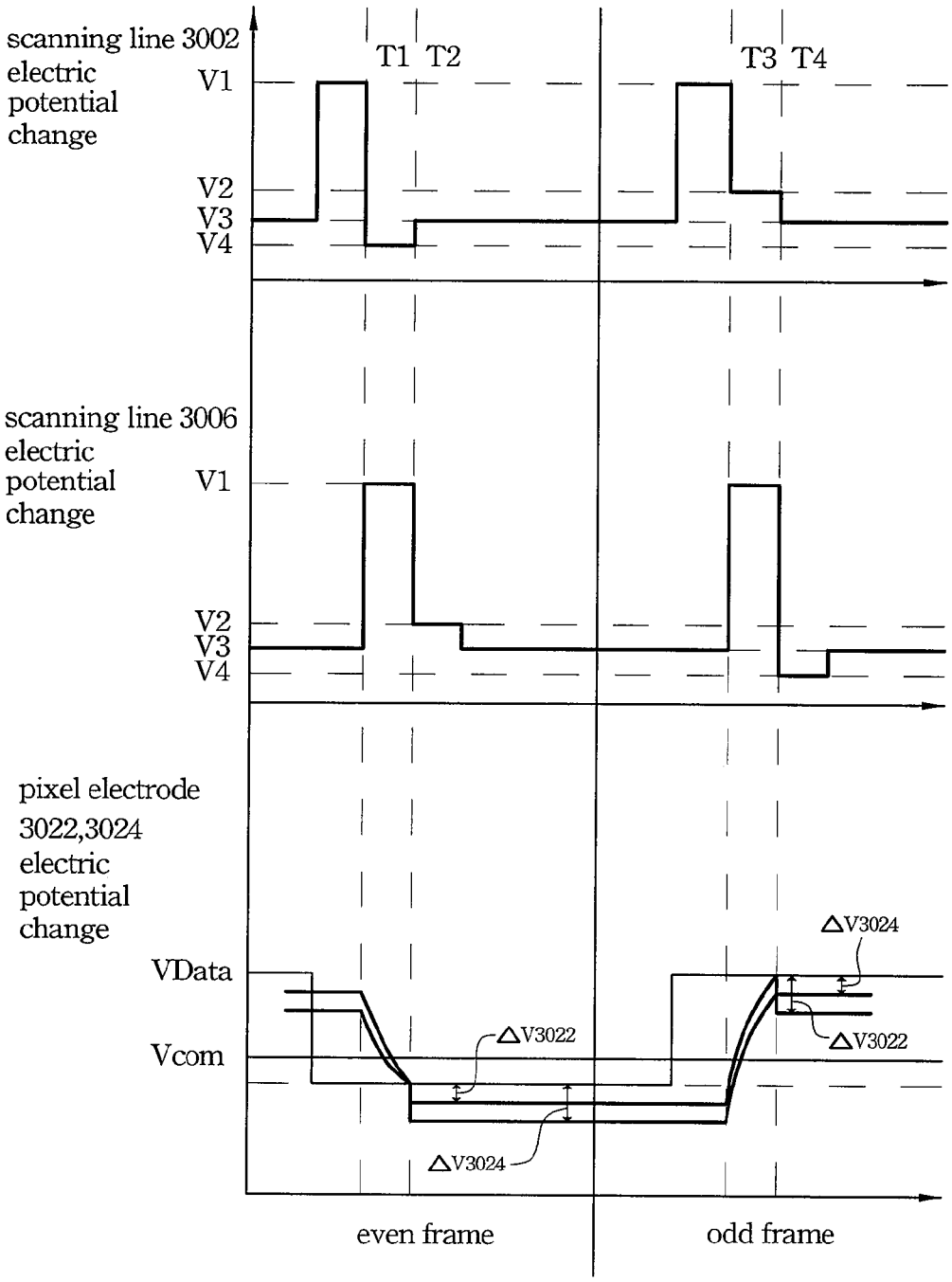
FIG. 7 illustrates the four-level drive waveform and the electric potential change of pixel electrodes according to an embodiment of the present invention.

FIG. 7 illustrates the four-level drive waveform and the electric potential change of pixel electrodes according to an embodiment of the present invention. Please refer to FIG. 7 and FIGS. 1A and 1B together. In this embodiment, the drive waveform includes four electric potentials, V1, V2, V3 and V4. The relationship among the three electric potentials is V1>V2>V3>V4. The left part of FIG. 7 illustrates the corresponding waveform in the even frame. The right part of FIG. 7 illustrates the corresponding waveform in the odd frame.

During the time segment T1 of the even frame, the scanning line 3006 is selected. The electric potential of the scanning line 3002 is pulled down to the electric potential V4. At this time, negative polarity data is transferred in the data line 3008. The electric potential of the gate electrodes of the thin film transistors 3010 and 3012 is increased to V1 to turn on the thin film transistors 3010 and 3012. The data in the data line 3008 is transferred to the pixel electrode 3022 through the thin film transistor 3010. The data in the data line 3008 is transferred to the pixel electrode 3024 through the thin film transistor 3012. When the time segment T1 is almost over, the pixel electrodes 3022 and 3024 have the same electric potential. During the time segment T2, the electric potential on the scanning line 3006 is pulled down to the electric potential V2 to turn off the thin film transistors 3010 and 3012. At this moment, the electric potential on the scanning line 3002 is pulled up from the electric potential V4 to the electric potential V3.

On the other hand, the scanning line 3006 is coupled to the pixel electrodes 3022 and 3024 through the parasitical capacitors 3026 and 3028 respectively. Therefore, the electric potentials of the pixel electrodes 3022 and 3024 is affected by the electric potential variation (V1-V2) of the scanning line 3006 during the time segment T2.

Moreover, the scanning line 3002 is coupled to the pixel electrode 3022 through the storage capacitors 3014. Therefore, the electric potential of the pixel electrode 3022 is also affected by the electric potential variation of the scanning line 3002. During the time segment T2 of the even frame, the electric potential of the scanning line 3002 is pulled up from the electric potential V4 to the electric potential V3. The electric potential variation (V3-V4) of the scanning line 3002 is coupled to the pixel electrode 3022 to reduce the absolute value of the electric potential of the pixel electrode 3022. Such variation separates the electric potential value between the pixel electrodes 3022 and 3024. The different electric potential value between the pixel electrodes 3022 and 3024 makes the transmissive region and the reflective region of the pixel unit 300 have same optical characteristics.

During the time segment T2, the electric potential variation of the pixel electrode 3024, ΔV(3024), is described in the following:

$$\Delta V(3024) = \frac{C_{gs}(3028)}{C_T(3024)}(V1 - V2), \text{ and}$$

$$C_T(3024) = C_{lc}(3020) + C_{st}(3016) + C_{gs}(3028)$$

The $C_T$ (3024) is the total capacitance related to the pixel electrode 3024. The $C_{lc}$ (3020) is the capacitance of the liquid crystal capacitor 3020. The $C_{st}$ (3016) is the capacitance of the storage capacitor 3016. The $C_{gs}$ (3028) is the capacitance of the parasitical capacitor 3028.

During time segment T2, the electric potential variation of the pixel electrode 3022, ΔV(3022), is described in the following:

$$\Delta V(3022) = \left|\frac{C_{gs}(3026)}{C_T(3022)}(V1 - V2) - \frac{C_{st}(3014)}{C_T(3022)}(V3 - V4)\right|, \text{ and}$$

$$C_T(3022) = C_{lc}(3018) + C_{st}(3014) + C_{gs}(3026)$$

The $C_T$ (3022) is the total capacitance related to the pixel electrode 3022. The $C_{lc}$ (3018) is the capacitance of the liquid crystal capacitor 3018. The $C_{st}$ (3014) is the capacitance of the storage capacitor 3014. The $C_{gs}$ (3026) is the capacitance of the parasitical capacitor 3026.

Moreover, $$\frac{C_{st}(3014)}{C_T(3022)}(V3 - V4)$$

is the electric potential variation of the pixel electrode 3022 because of the coupling effect from the scanning line 3002.

In the odd frame of FIG. 7, positive polarity data is transferred in the data line 3008. Please refer to FIG. 7 and FIGS. 1A and 1B together. During the time segment T3 of the odd frame, the four step drive waveform for driving the scanning line 3006 is pulled up to the electric potential V1 to turn on the thin film transistors 3010 and 3012. When the time segment T3 is almost over, the pixel electrodes 3022 and 3024 have the same electric potential. At this time, the electric potential of the scanning line 3002 is pulled down to the electric potential V2. During the time segment T4 of the odd frame, the four-level drive waveform for driving the scanning line 3006 is pulled down to the lowest electric potential V4 to turn off the thin film transistor 3010 and 3012. At this time, the drive waveform for driving the scanning line 3002 is pulled down to the electric potential V3. The electric potential variation (V2-V3) of the scanning line 3002 is coupled to the pixel electrode 3022 through the storage capacitor 3014 to increase the absolute value of the electric potential variation of the pixel electrode 3022. Such variation separates the electric potential value between the pixel electrodes 3022 and 3024. The different electric potential values between the pixel electrodes 3022 and 3024 makes the transmissive region and the reflective region of the pixel unit 300 have same optics characteristics. The advantage of using a four-level drive waveform is that more parameters are used to change the electric potential of the pixel electrodes 3022 and 3024.

During the time segment T4, the electric potential variation of the pixel electrode 3024, ΔV(3024), is described in the following:

$$\Delta V(3024) = \frac{C_{gs}(3028)}{C_T(3024)}(V1 - V4), \text{ and}$$

$$C_T(3024) = C_{lc}(3020) + C_{st}(3016) + C_{gs}(3028)$$

The $C_T$ (3024) is the total capacitance related to the pixel electrode 3024. The $C_{lc}$ (3020) is the capacitance of the liquid crystal capacitor 3020. The $C_{st}$ (3016) is the capacitance of the storage capacitor 3016. The $C_{gs}$ (3028) is the capacitance of the parasitical capacitor 3028.

During the time segment T4, the electric potential variation of the pixel electrode 3022, ΔV(3022), is described in the following:

$$\Delta V(3022) = \frac{C_{gs}(3026)}{C_T(3022)}(V1 - V4) + \frac{C_{st}(3014)}{C_T(3022)}(V2 - V3), \text{ and}$$

$$C_T(3022) = C_{lc}(3018) + C_{st}(3014) + C_{gs}(3026)$$

The $C_T$ (3022) is the total capacitance related to the pixel electrode 3022. The $C_{lc}$ (3018) is the capacitance of the liquid crystal capacitor 3018. The $C_{st}$ (3014) is the capacitance of the storage capacitor 3014. The $C_{gs}$ (3026) is the capacitance of the parasitical capacitor 3026.

The foregoing application of the drive waveform illustrated in FIG. 7 is based on the pixel unit 300 of the first embodiment in FIGS. 1A and 1B. However, it is noticed that the drive waveform illustrated in FIG. 7 also is used in the pixel unit 400 of the second embodiment in FIG. 2, in the pixel unit 500 of the third embodiment in FIG. 3 and in the pixel unit 600 of the fourth embodiment in FIG. 4.

Figure 8:
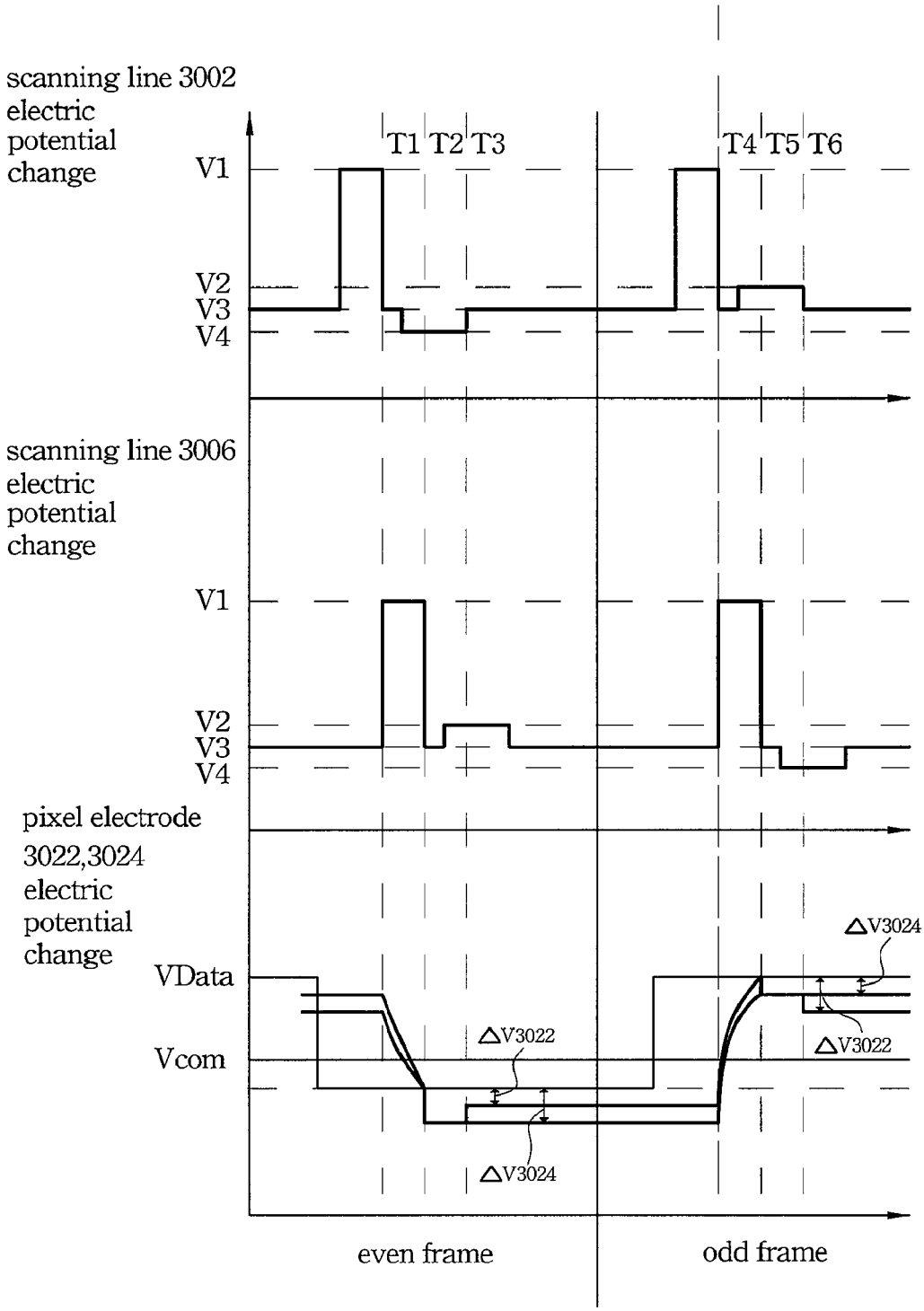
FIG. 8 illustrates the two steps four-level drive waveform and the electric potential change of pixel electrodes according to an embodiment of the present invention.

FIG. 8 illustrates the two steps four-level drive waveform and the electric potential change of pixel electrodes according to an embodiment of the present invention. Please refer to FIG. 8 and FIGS. 1A and 1B together. In this embodiment, the drive waveform includes four electric potentials, V1, V2, V3 and V4. The relationship among the three electric potential is V1>V2>V3>V4. In this two-steps four-level drive waveform, the waveform transition is always from electric potential V3 to the destination electric potential. Such transition avoids the waveform distortion result from time delay and drive waveform un-uniform to degrade the display performance. The left part of FIG. 8 illustrates the corresponding waveform in the even frame. The right part of FIG. 8 illustrates the corresponding waveform in the odd frame.

During the time segment T1 of the even frame, the scanning line 3006 is selected. The electric potential of the scanning line 3006 is pulled up to the electric potential V1 to turn on the thin film transistors 3010 and 3012. The data in the data line 3008 is transferred to the pixel electrode 3022 through the thin film transistor 3010. The data in the data line 3008 is transferred to the pixel electrode 3024 through the thin film transistor 3012. When the time segment T1 being almost over, the pixel electrodes 3022 and 3024 have the same electric potential. At this time, the electric potential of the scanning line 3002 is pulled down to the electric potential V4 from the electric potential V3. During the time segment T2, the electric potential of the scanning line 3006 is first pulled down to the electric potential V3, then, to the electric potential V2 to turn off the thin film transistor 3010 and 3012.

On the other hand, the scanning line 3006 is coupled to the pixel electrodes 3022 and 3024 through the parasitical capacitors 3026 and 3028 respectively. Therefore, the electric potential of the pixel electrodes 3022 and 3024 is affected by the electric potential variation (V1-V2) of the scanning line 3006 during the time segment T2. In this time segment T2, the pixel electrodes 3022 and 3024 have the almost same electric potential.

During the time segment T3, the electric potential of the scanning line 3002 is pulled up from the electric potential V4 to the electric potential V3. The scanning line 3002 is coupled to the pixel electrode 3022 through the storage capacitors 3014. Therefore, the electric potential variation of the scanning line 3002 affects the electric potential of the pixel electrode 3022. The electric potential variation (V3-V4) of the scanning line 3002 is coupled to the pixel electrode 3022 to reduce the absolute value of the electric potential of the pixel electrode 3022. Such variation separates the electric potential value between the pixel electrodes 3022 and 3024. The different electric potential value between the pixel electrodes 3022 and 3024 makes the transmissive region and the reflective region of the pixel unit 300 have same optics characteristics.

During the time segment T3, the electric potential variation of the pixel electrode 3024, ΔV(3024), is described in the following:

$$\Delta V(3024) = \frac{C_{gs}(3028)}{C_T(3024)}(V1 - V2), \text{ and}$$

$$C_T(3024) = C_{lc}(3020) + C_{st}(3016) + C_{gs}(3028)$$

The $C_T$ (3024) is the total capacitance related to the pixel electrode 3024. The $C_{lc}$ (3020) is the capacitance of the liquid crystal capacitor 3020. The $C_{st}$ (3016) is the capacitance of the storage capacitor 3016. The $C_{gs}$ (3028) is the capacitance of the parasitical capacitor 3028.

During the time segment T3, the electric potential variation of the pixel electrode 3022, ΔV(3022), is described in the following:

$$\Delta V(3022) = \left|\frac{C_{gs}(3026)}{C_T(3022)}(V1 - V2) - \frac{C_{st}(3014)}{C_T(3022)}(V3 - V4)\right|, \text{ and}$$

$$C_T(3022) = C_{lc}(3018) + C_{st}(3014) + C_{gs}(3026)$$

The $C_T$ (3022) is the total capacitance related to the pixel electrode 3022. The $C_{lc}$ (3018) is the capacitance of the liquid crystal capacitor 3018. The $C_{st}$ (3014) is the capacitance of the storage capacitor 3014. The $C_{gs}$ (3026) is the capacitance of the parasitical capacitor 3026.

Moreover, $$\frac{C_{st}(3014)}{C_T(3022)}(V3 - V4)$$

is the electric potential variation of the pixel electrode 3022 because of the coupling effect from the scanning line 3002.

In the odd frame of FIG. 8, positive polarity data is transferred in the data line 3008. Please refer to FIG. 8 and FIGS. 1A and 1B together. During the time segment T4 of the odd frame, the drive waveform for driving the scanning line 3006 is pulled up to the electric potential V1 to turn on the thin film transistors 3010 and 3012. When the time segment T4 is almost over, the pixel electrodes 3022 and 3024 almost have the same electric potential. During the time segment T4, the electric potential of the scanning line 3002 is first pulled down to the electric potential V3, then, pulled up the electric potential V2. During the time segment T5, the drive waveform for the driving the scanning line 3006 is pulled down to the lowest electric potential V4 to turn off the thin film transistor 3010 and 3012. At this time, the pixel electrode 3022 is isolated to the pixel electrode 3024. The pixel electrodes 3022 and 3024 almost have the same electric potential. During the time segment T6 of the odd frame, the drive waveform for driving the scanning line 3002 is pulled down to the electric potential V3. The electric potential variation (V2-V3) of the scanning line 3002 is coupled to the pixel electrode 3022 through the storage capacitor 3014 to increase the absolute value of the electric potential variation of the pixel electrode 3022. Such variation separates the electric potential value between the pixel electrodes 3022 and 3024. The different electric potential value between the pixel electrodes 3022 and 3024 makes the transmissive region and the reflective region of the pixel unit 300 have same optical characteristics. The advantage of using four-level drive waveform is that more parameters are used to change the electric potential of the pixel electrodes 3022 and 3024.

During the time segment T6, the electric potential variation of the pixel electrode 3024, ΔV(3024), is described in the following:

$$\Delta V(3024) = \frac{C_{gs}(3028)}{C_T(3024)}(V1 - V4), \text{ and}$$

$$C_T(3024) = C_{lc}(3020) + C_{st}(3016) + C_{gs}(3028)$$

The $C_T$ (3024) is the total capacitance related of the pixel electrode 3024. The $C_{lc}$ (3020) is the capacitance of the liquid crystal capacitor 3020. The $C_{st}$ (3016) is the capacitance of the storage capacitor 3016. The $C_{gs}$ (3028) is the capacitance of the parasitical capacitor 3028.

During the time segment T6, the electric potential variation of the pixel electrode 3022, ΔV(3022), is described in the following:

$$\Delta V(3022) = \frac{C_{gs}(3026)}{C_T(3022)}(V1 - V4) + \frac{C_{st}(3014)}{C_T(3022)}(V2 - V3), \text{ and}$$

$$C_T(3022) = C_{lc}(3018) + C_{st}(3014) + C_{gs}(3026)$$

The $C_T$ (3022) is the total capacitance related to the pixel electrode 3022. The $C_{lc}$ (3018) is the capacitance of the liquid crystal capacitor 3018. The $C_{st}$ (3014) is the capacitance of the storage capacitor 3014. The $C_{gs}$ (3026) is the capacitance of the parasitical capacitor 3026.

The foregoing application of the drive waveform illustrated in FIG. 8 is based on the pixel unit 300 of the first embodiment in FIGS. 1A and 1B. However, it is noticed that the drive waveform illustrated in FIG. 8 also is used in the pixel unit 400 of the second embodiment in FIG. 2, in the pixel unit 500 of the third embodiment in FIG. 3 and in the pixel unit 600 of the fourth embodiment in FIG. 4.

Figure 9:
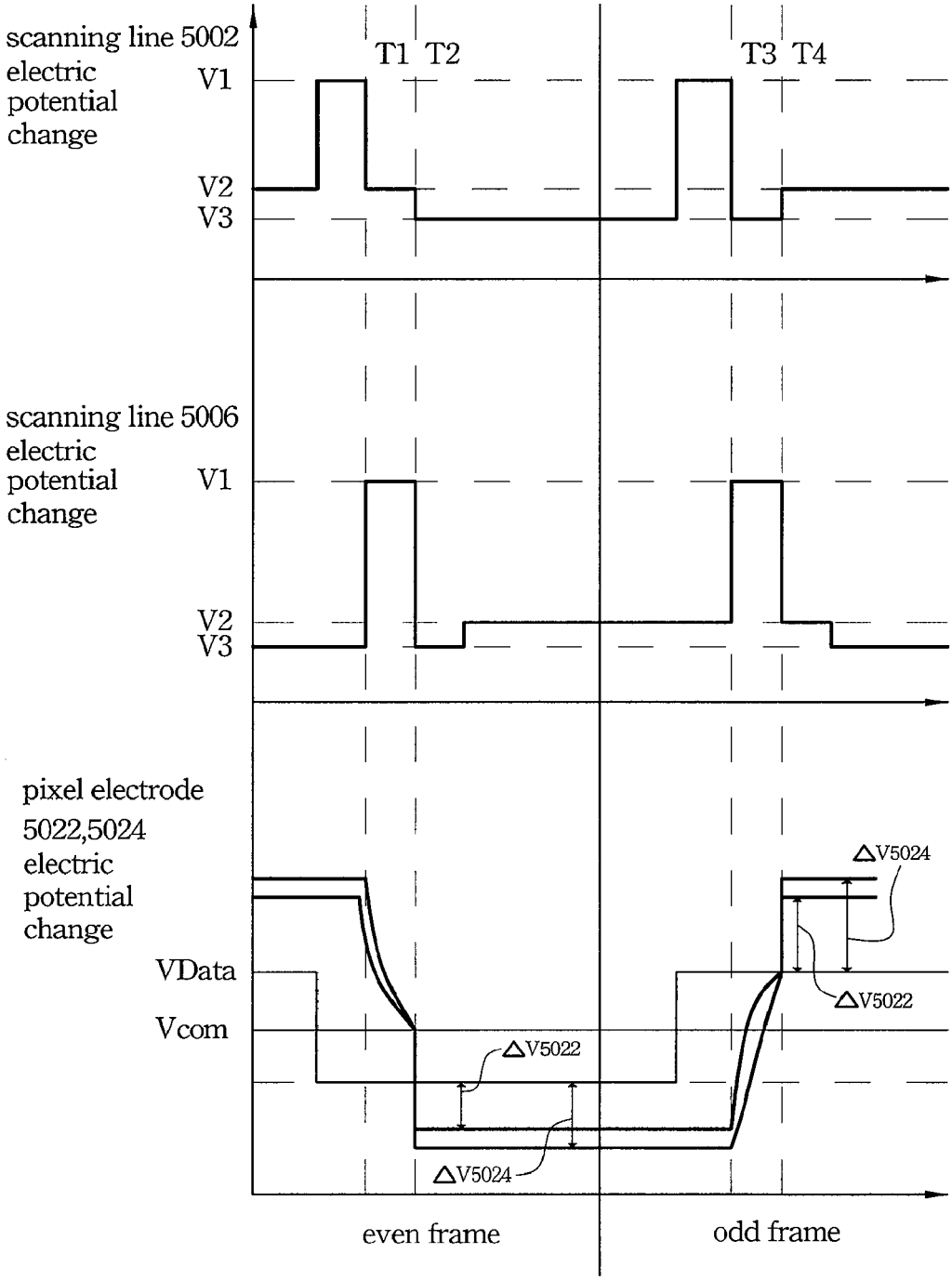
FIG. 9 illustrates the three-level drive waveform and the electric potential change of pixel electrodes according to an embodiment of the present invention.

FIG. 9 illustrates the three-level drive waveform and the electric potential change of pixel electrodes according to an embodiment of the present invention. Please refer to FIG. 9 and FIG. 3 together. In this embodiment, the drive waveform includes three electric potentials, V1, V2 and V3. The relationship among the three electric potential is V1>V2>V3. The left part of FIG. 9 illustrates the corresponding waveform in the even frame. The right part of FIG. 9 illustrates the corresponding waveform in the odd frame.

During the time segment T1 of the even frame, the scanning line 5006 is selected. At this time, a negative polarity data is transferred in the data line 5008. The electric potential of the gate electrodes of the thin film transistors 5010 and 5012 is increased to V1 to turn on the thin film transistors 5010 and 5012. The data in the data line 5008 is transferred to the pixel electrode 5022 through the thin film transistor 5010. The data in the data line 5008 is transferred to the pixel electrode 5024 through the thin film transistor 5012. When the time segment T1 is almost over, the pixel electrodes 5022 and 5024 have the same electric potential. During the time segment T2, the electric potential applied to the scanning line 5006 is reduced to the electric potential V3 to turn off the thin film transistors 5010 and 5012. Therefore, the two pixel electrodes are isolated.

On the other hand, the scanning line 5006 is coupled to the pixel electrode 5022 through the parasitical capacitors 5026. The scanning line 5006 is coupled to the pixel electrode 5024 through the parasitical capacitors 5028. Therefore, the electric potential of the pixel electrodes 5022 and 5024 is affected by the electric potential variation (V1-V3) of the scanning line 5006 during the time segment T2.

Moreover, the scanning line 5002 is coupled to the pixel electrode 5022 through the storage capacitors 5014. The scanning line 5002 is coupled to the pixel electrode 5024 through the storage capacitors 5016. Therefore, the electric potentials of the pixel electrodes 5022 and 5024 are also affected by the electric potential variation of the scanning line 5002. During the time segment T2, the electric potential of the scanning line 5002 is changed from electric potential V2 to electric potential V3. The reduced electric potential variation (V2-V3) of the scanning line 5002 is coupled to the pixel electrodes 5022 and 5024. Modifying the capacitances of the storage capacitors 5014 and 5016 separates the electric potentials of the pixel electrodes 5022 and 5024. The different electric potential value forms different Gamma curves makes the transmissive region and the reflective region of the pixel unit 500 have same optical characteristics. The coupling effect of the scanning lines reduces the electrical potential output range of the data line to reduce the power consumption.

During the time segment T2, the electric potential variation of the pixel electrode 5024, ΔV(5024), is described in the following:

$$\Delta V(5024) = \frac{C_{gs}(5028)}{C_T(5024)}(V1 - V3) + \frac{C_{st}(5016)}{C_T(5024)}(V2 - V3), \text{ and}$$

$$C_T(5024) = C_{lc}(5020) + C_{st}(5016) + C_{gs}(5028)$$

The $C_T$ (5024) is the total capacitance related to the pixel electrode 5024. The $C_{lc}$ (5020) is the capacitance of the liquid crystal capacitor 5020. The $C_{st}$ (5016) is the capacitance of the storage capacitor 5016. The $C_{gs}$ (5028) is the capacitance of the parasitical capacitor 5028.

Moreover, $$\frac{C_{st}(5016)}{C_T(5024)}(V2 - V3)$$

is the electric potential variation value of the pixel electrode 5024 because of the coupling effect from the scanning line 5002.

During the time segment T2, the electric potential variation of the pixel electrode 5022, ΔV(5022), is described in the following:

$$\Delta V(5022) = \frac{C_{gs}(5026)}{C_T(5022)}(V1 - V3) + \frac{C_{st}(5014)}{C_T(5022)}(V2 - V3), \text{ and}$$

$$C_T(5022) = C_{lc}(5018) + C_{st}(5014) + C_{gs}(5026)$$

The $C_T$ (5022) is the total capacitance related to the pixel electrode 5022. The $C_{lc}$ (5018) is the capacitance of the liquid crystal capacitor 5018. The $C_{st}$ (5014) is the capacitance of the storage capacitor 5014. The $C_{gs}$ (5026) is the capacitance of the parasitical capacitor 5026.

Moreover, $$\frac{C_{st}(5014)}{C_T(5022)}(V2 - V3)$$

is the electric potential variation value of the pixel electrode 5022 because of the coupling effect from the scanning line 5002.

In the odd frame, positive polarity data is transferred in the data line 5008. Please refer to FIG. 9 and FIG. 3 together. The main difference between the odd frame and the even frame is described in the following. During the time segment T2 of the even frame, the drive waveform for driving the scanning line 5002 is pulled down to the lowest electric potential V3 from the electric potential V2. Such a driving waveform increases the absolute value of the electric potential variation in the pixel electrodes 5022 and 5024.

However, the drive waveform in the odd frame is different from the drive waveform in the even frame. During the time segment T4 of the odd frame, the drive waveform for driving the scanning line 5006 is pulled down to the electric potential V2 from the electric potential V1 to turn off the thin film transistor 5010 and 5012. The drive waveform for driving the scanning line 5002 is pulled up to the electric potential V2 from the electric potential V3. Such drive waveforms increase the absolute value of the electric potential variation in the pixel electrodes 5022 and 5024.

During the time segment T4, the electric potential variation of the pixel electrode 5024, ΔV(5024), is described in the following:

$$\Delta V(5024) = \left|\frac{C_{gs}(5028)}{C_T(5024)}(V1 - V2) - \frac{C_{st}(5016)}{C_T(5024)}(V2 - V3)\right|, \text{ and}$$

$$C_T(5024) = C_{lc}(5020) + C_{st}(5016) + C_{gs}(5028)$$

The $C_T$ (5024) is the total capacitance related to the pixel electrode 5024. The $C_{lc}$ (5020) is the capacitance of the liquid crystal capacitor 5020. The $C_{st}$ (5016) is the capacitance of the storage capacitor 5016. The $C_{gs}$ (5028) is the capacitance of the parasitical capacitor 5028.

During the time segment T4, the electric potential variation of the pixel electrode 5022, ΔV(5022), is described in the following:

$$\Delta V(5022) = \left|\frac{C_{gs}(5026)}{C_T(5022)}(V1 - V2) - \frac{C_{st}(5014)}{C_T(5022)}(V2 - V3)\right|, \text{ and, and}$$

$$C_T(5022) = C_{lc}(5018) + C_{st}(5014) + C_{gs}(5026)$$

The $C_T$ (5022) is the total capacitance related to the pixel electrode 5022. The $C_{lc}$ (5018) is the capacitance of the liquid crystal capacitor 5018. The $C_{st}$ (5014) is the capacitance of the storage capacitor 5014. The $C_{gs}$ (5026) is the capacitance of the parasitical capacitor 5026.

The foregoing application of the drive waveform illustrated in FIG. 9 is based on the pixel unit 500 of the first embodiment in FIG. 3. However, it is noticed that the drive waveform illustrated in FIG. 9 also be used in the pixel unit 600 of the fourth embodiment in FIG. 4.

Figure 10:
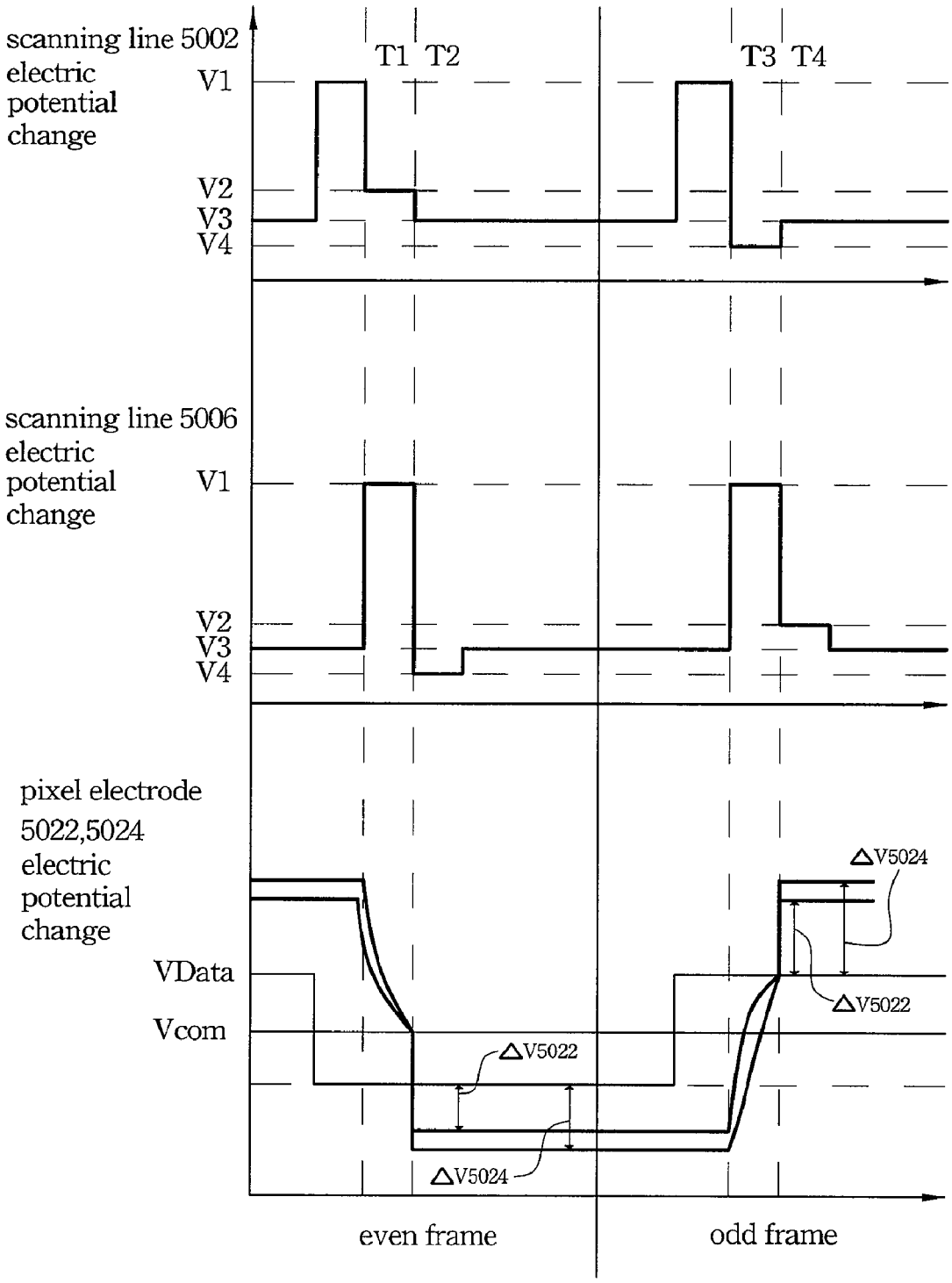
FIG. 10 illustrates the four-level drive waveform and the electric potential change of pixel electrodes according to an embodiment of the present invention.

FIG. 10 illustrates the four-level drive waveform and the electric potential change of pixel electrodes according to an embodiment of the present invention. Please refer to FIG. 10 and FIG. 3 together. In this embodiment, the drive waveform includes four electric potentials, V1, V2, V3 and V4. The relationship among the four electric potential is V1>V2>V3>V4. Due to the coupling effect of the scanning line 5002, the output voltage of the data line is reduced. When the four-level drive waveform is applied to the pixel unit in the FIG. 3, the electrical potential of the pixel is increased or reduced by the coupling effect of the scanning line 5002. Such coupling reduces the electrical potential output range of the data line to reduce the power consumption. The left part of FIG. 10 illustrates the corresponding waveform in the even frame. The right part of FIG. 10 illustrates the corresponding waveform in the odd frame.

During the time segment T1 of the even frame, the scanning line 5006 is selected. The electric potential of the scanning line 5002 is pulled down to the electric potential V2. At this time, a negative polarity data is transferred in the data line 5008. The electric potentials of the gate electrodes of the thin film transistors 5010 and 5012 are increased to V1 to turn on the thin film transistors 5010 and 5012. The data in the data line 5008 is transferred to the pixel electrode 5022 through the thin film transistor 5010. The data in the data line 5008 is transferred to the pixel electrode 5024 through the thin film transistor 5012. When the time segment T1 is almost over, the pixel electrodes 5022 and 5024 have the same electric potential. During the time segment T2, the electric potential on the scanning line 5006 is pulled down to the electric potential V4 to turn off the thin film transistors 5010 and 5012. At this moment, the electric potential on the scanning line 5002 is pulled down from the electric potential V2 to the electric potential V3.

On the other hand, the scanning line 5006 is coupled to the pixel electrode 5022 through the parasitical capacitor 5026. The scanning line 5006 is coupled to the pixel electrode 5024 through the parasitical capacitor 5028. Therefore, the electric potentials of the pixel electrodes 5022 and 5024 are affected by the electric potential variation (V1-V4) of the scanning line 5006 during the time segment T2.

Moreover, the scanning line 5002 is coupled to the pixel electrode 5022 through the storage capacitors 5014. The scanning line 5002 is coupled to the pixel electrode 5024 through the storage capacitors 5016. Therefore, the electric potentials of the pixel electrodes 5022 and 5024 are also affected by the electric potential variation of the scanning line 5002. Modifying the capacitance of the storage capacitors 5014 and 5016 separates the electric potentials of the pixel electrodes 5022 and 5024. The different electric potential value makes the transmissive region and the reflective region of the pixel unit 500 have same optical characteristics.

During the time segment T2, the electric potential variation of the pixel electrode 5024, ΔV(5024), is described in the following:

$$\Delta V(5024) = \frac{C_{gs}(5028)}{C_T(5024)}(V1 - V4) + \frac{C_{st}(5016)}{C_T(5024)}(V2 - V3), \text{ and}$$

$$C_T(5024) = C_{lc}(5020) + C_{st}(5016) + C_{gs}(5028)$$

The $C_T$ (5024) is the total capacitance related to the pixel electrode 5024. The $C_{lc}$ (5020) is the capacitance of the liquid crystal capacitor 5020. The $C_{st}$ (5016) is the capacitance of the storage capacitor 5016. The $C_{gs}$ (5028) is the capacitance of the parasitical capacitor 5028.

Moreover, $$\frac{C_{st}(5016)}{C_T(5024)}(V2 - V3)$$

is the electric potential variation value of the pixel electrode 5024 because of the coupling effect from the scanning line 5002.

During the time segment T2, the electric potential variation of the pixel electrode 5022, ΔV(5022), is described in the following:

$$\Delta V(5022) = \frac{C_{gs}(5026)}{C_T(5022)}(V1 - V4) + \frac{C_{st}(5014)}{C_T(5022)}(V2 - V3), \text{ and}$$

$$C_T(5022) = C_{lc}(5018) + C_{st}(5014) + C_{gs}(5026)$$

The $C_T$ (5022) is the total capacitance related to the pixel electrode 5022. The $C_{lc}$ (5018) is the capacitance of the liquid crystal capacitor 5018. The $C_{st}$ (5014) is the capacitance of the storage capacitor 5014. The $C_{gs}$ (5026) is the capacitance of the parasitical capacitor 5026.

Moreover, $$\frac{C_{st}(5014)}{C_T(5022)}(V2 - V3)$$

is the electric potential variation value of the pixel electrode 5022 because of the coupling effect from the scanning line 5002.

In the odd frame, positive polarity data is transferred in the data line 5008. Please refer to FIG. 10 and FIG. 3 together. During the time segment T3 of the odd frame, the drive waveform for driving the scanning line 5002 is pulled down to the electric potential V4. The drive waveform for driving the scanning line 5006 is pulled up to the electric potential V1 to turn on the thin film transistors 5010 and 5012. The data in the data line 5008 is transferred to the pixel electrode 5022 through the thin film transistor 5010. The data in the data line 5008 is transferred to the pixel electrode 5024 through the thin film transistor 5012. When the time segment T3 is almost over, the pixel electrodes 5022 and 5024 have the same electric potential.

During the time segment T4, the electric potential on the scanning line 5006 is pulled down to the electric potential V2 to turn off the thin film transistor 5010 and 5012. At this moment, the electric potential on the scanning line 5002 is pulled up from the electric potential V4 to the electric potential V3. The scanning line 5002 is coupled to the pixel electrode 5022 through the storage capacitor 5014. The scanning line 5002 is coupled to the pixel electrode 5024 through the storage capacitor 5016. Therefore, the electric potentials of the pixel electrodes 5022 and 5024 are affected by the electric potential variation (V3-V4) of the scanning line 5002. Modifying the capacitance of the storage capacitors 5014 and 5016 separates the electric potentials of the pixel electrodes 5022 and 5024. The different electric potential value makes the transmissive region and the reflective region of the pixel unit 500 have same optics characteristics. The advantage of using the four level drive waveform is that the electrical potential output range of the data line is reduced for power saving.

During the time segment T4, the electric potential variation of the pixel electrode 5024, ΔV(5024), is described in the following:

$$\Delta V(5024) = \left|\frac{C_{gs}(5028)}{C_T(5024)}(V1 - V2) - \frac{C_{st}(5016)}{C_T(5024)}(V3 - V4)\right|, \text{ and}$$

$$C_T(5024) = C_{lc}(5020) + C_{st}(5016) + C_{gs}(5028)$$

The $C_T$ (5024) is the total capacitance related to the pixel electrode 5024. The $C_{lc}$ (5020) is the capacitance of the liquid crystal capacitor 5020. The $C_{st}$ (5016) is the capacitance of the storage capacitor 5016. The $C_{gs}$ (5028) is the capacitance of the parasitical capacitor 5028.

During the time segment T4, the electric potential variation of the pixel electrode 5022, ΔV(5022), is described in the following:

$$\Delta V(5022) = \left|\frac{C_{gs}(5026)}{C_T(5022)}(V1 - V2) - \frac{C_{st}(5014)}{C_T(5022)}(V3 - V4)\right|, \text{ and, and}$$

$$C_T(5022) = C_{lc}(5018) + C_{st}(5014) + C_{gs}(5026)$$

The $C_T$ (5022) is the total capacitance related to the pixel electrode 5022. The $C_{lc}$ (5018) is the capacitance of the liquid crystal capacitor 5018. The $C_{st}$ (5014) is the capacitance of the storage capacitor 5014. The $C_{gs}$ (5026) is the capacitance of the parasitical capacitor 5026.

The foregoing application of the drive waveform illustrated in FIG. 10 is based on the pixel unit 500 of the third embodiment in FIG. 3. However, it is noticed that the drive waveform illustrated in FIG. 10 also is used in the pixel unit 600 of the fourth embodiment in FIG. 4.

Figure 11:
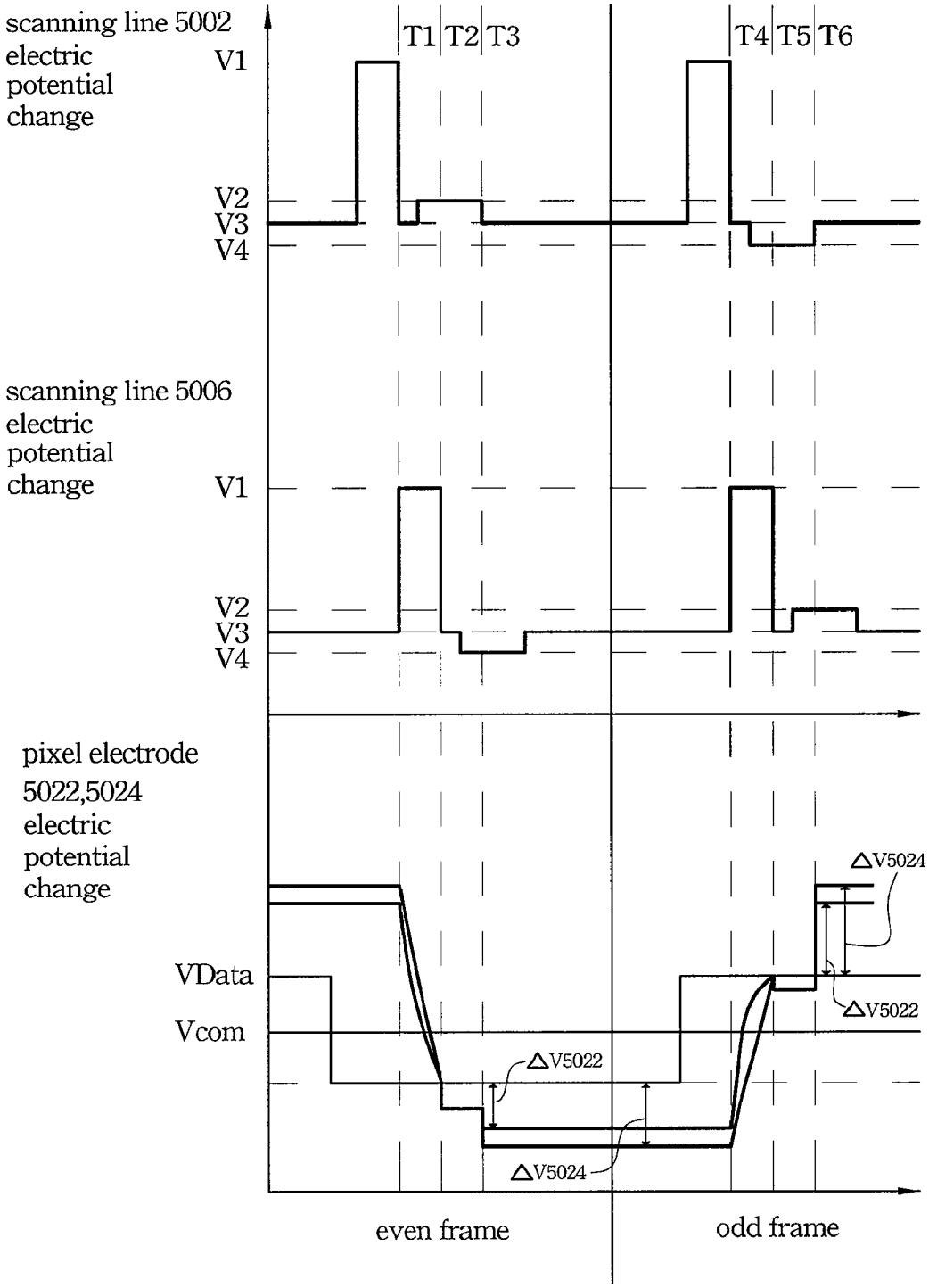
FIG. 11 illustrates the two steps four-level drive waveform and the electric potential change of pixel electrodes according to an embodiment of the present invention.

FIG. 11 illustrates the two-step four-level drive waveform and the electric potential change of pixel electrodes according to an embodiment of the present invention. Please refer to FIG. 11 and FIG. 3 together. In this embodiment, the drive waveform includes four electric potentials, V1, V2, V3 and V4. The relationship among the four electric potentials is V1>V2>V3>V4. In the two-step four-level drive waveform, the waveform transition is always changed from the electric potential V3 to the destination electric potential. Such transitions avoid the waveform distortion resulted from the time delay and non-uniform drive waveform to degrade the display performance. The left part of FIG. 11 illustrates the corresponding waveform in the even frame. The right part of FIG. 11 illustrates the corresponding waveform in the odd frame.

During the time segment T1 of the even frame, the electric potential of the scanning line 5002 is first pulled down to the electric potential V3, then pulled up to the electric potential V2. The electric potential of the scanning line 5006 is pulled up to the electric potential V1 to turn on the thin film transistors 5010 and 5012. The data in the data line 5008 is transferred to the pixel electrode 5022 through the thin film transistor 5010. The data in the data line 5008 is transferred to the pixel electrode 5024 through the thin film transistor 5012. When the time segment T1 is almost over, the pixel electrodes 5022 and 5024 have the same electric potential. During the time segment T2, the electric potential on the scanning line 5006 is first pulled down to the electric potential V3, then, pulled down to the electric potential V4 to turn off the thin film transistors 5010 and 5012.

On the other hand, the scanning line 5006 is coupled to the pixel electrodes 5022 and 5024 through the parasitical capacitors 5026 and 5028 respectively. Therefore, the electric potentials of the pixel electrodes 5022 and 5024 are affected by the electric potential variation (V1-V4) of the scanning line 5006 during the time segment T2. In this time segment T3, the electric potential of the scanning line 5002 is pulled down to the electric potential V3 from the electric potential V2.

The scanning line 5002 is coupled to the pixel electrode 5022 through the storage capacitors 5014. The scanning line 5002 is coupled to the pixel electrode 5024 through the storage capacitor 5016. Therefore, the electric potentials of the pixel electrodes 5022 and 5024 are affected by the electric potential variation (V2-V3) of the scanning line 5002. The electric potential variation (V2-V3) of the scanning line 5002 is coupled to the pixel electrodes 5022 and 5024 to increase the absolute value of the electric potential of the pixel electrodes 5022 and 5024. Such variation separates the electric potential value between the pixel electrodes 5022 and 5024. The different electric potential value between the pixel electrodes 5022 and 5024 makes the transmissive region and the reflective region of the pixel unit 500 have same optical characteristics.

During the time segment T3, the electric potential variation of the pixel electrode 5024, ΔV(5024), is described in the following:

$$\Delta V(5024) = \frac{C_{gs}(5028)}{C_T(5024)}(V1 - V4) + \frac{C_{st}(5016)}{C_T(5024)}(V2 - V3), \text{ and}$$

$$C_T(5024) = C_{lc}(5020) + C_{st}(5016) + C_{gs}(5028)$$

The $C_T$ (5024) is the total capacitance related to the pixel electrode 5024. The $C_{lc}$ (5020) is the capacitance of the liquid crystal capacitor 5020. The $C_{st}$ (5016) is the capacitance of the storage capacitor 5016. The $C_{gs}$ (5028) is the capacitance of the parasitical capacitor 5028.

Moreover, $$\frac{C_{st}(5016)}{C_T(5024)}(V2 - V3)$$

is the electric potential variation value of the pixel electrode 5024 because of the coupling effect from the scanning line 5002.

During the time segment T2, the electric potential variation of the pixel electrode 5022, ΔV(5022), is described in the following:

$$\Delta V(5022) = \frac{C_{gs}(5026)}{C_T(5022)}(V1 - V4) + \frac{C_{st}(5014)}{C_T(5022)}(V2 - V3), \text{ and}$$

$$C_T(5022) = C_{lc}(5018) + C_{st}(5014) + C_{gs}(5026)$$

The $C_T$ (5022) is the total capacitance related to the pixel electrode 5022. The $C_{lc}$ (5018) is the capacitance of the liquid crystal capacitor 5018. The $C_{st}$ (5014) is the capacitance of the storage capacitor 5014. The $C_{gs}$ (5026) is the capacitance of the parasitical capacitor 5026.

Moreover, $$\frac{C_{st}(5014)}{C_T(5022)}(V2 - V3)$$

is the electric potential variation value of the pixel electrode 5022 because of the coupling effect from the scanning line 5002.

In the odd frame of FIG. 11, positive polarity data is transferred in the data line 5008. Please refer to FIG. 11 and FIG. 3 together. During the time segment T4 of the odd frame, the drive waveform for driving the scanning line 5006 is pulled up to the electric potential V1 to turn on the thin film transistors 5010 and 5012. The electric potential of the scanning line 5002 is fist pulled down to the electric potential V3, then, pulled down to the electric potential V4. During the time segment T5 of the odd frame, the drive waveform for driving the scanning line 5006 is pulled down to the electric potential V3, then, pulled up to the electric potential V2 to turn off the thin film transistor 5010 and 5012. At this time, an electric potential variation (V1-V2) is generated on the scanning line 5006. The pixel electrode 5022 is isolated from the pixel electrode 5024. During the time segment T6, the drive waveform for driving the scanning line 5002 is pulled up to the electric potential V3 to generate an electric potential variation (V3-V4). The electric potential variation (V3-V4) of the scanning line 5002 is coupled to the pixel electrodes 5022 and 5024 to increase the absolute value of the electric potential variation of the pixel electrodes 5022 and 5024. Such variation separates the electric potential value between the pixel electrodes 5022 and 5024. The different electric potential value between the pixel electrodes 5022 and 5024 makes the transmissive region and the reflective region of the pixel unit 500 have same optics characteristics. The advantage of using a four-level drive waveform is that more parameters are used to change the electric potential of the pixel electrodes 5022 and 5024.

During the time segment T6, the electric potential variation of the pixel electrode 5024, ΔV(5024), is described in the following:

$$\Delta V(5024) = \left|\frac{C_{gs}(5028)}{C_T(5024)}(V1 - V2) - \frac{C_{st}(5016)}{C_T(5024)}(V3 - V4)\right|, \text{ and}$$

$$C_T(5024) = C_{lc}(5020) + C_{st}(5016) + C_{gs}(5028)$$

The $C_T$ (5024) is the total capacitance related to the pixel electrode 5024. The $C_{lc}$ (5020) is the capacitance of the liquid crystal capacitor 5020. The $C_{st}$ (5016) is the capacitance of the storage capacitor 5016. The $C_{gs}$ (5028) is the capacitance of the parasitical capacitor 5028.

Moreover, $$\frac{C_{st}(5016)}{C_T(5024)}(V3 - V4)$$

is the electric potential variation value of the pixel electrode 5024 because of the coupling effect from the scanning line 5002.

The electric potential variation of the pixel electrode 5022, ΔV(5022), is described in the following:

$$\Delta V(5022) = \left|\frac{C_{gs}(5026)}{C_T(5022)}(V1 - V2) - \frac{C_{st}(5014)}{C_T(5022)}(V3 - V4)\right|, \text{ and}$$

$$C_T(5022) = C_{lc}(5018) + C_{st}(5014) + C_{gs}(5026)$$

The $C_T$ (5022) is the total capacitance related to the pixel electrode 5022. The $C_{lc}$ (5018) is the capacitance of the liquid crystal capacitor 5018. The $C_{st}$ (5014) is the capacitance of the storage capacitor 5014. The $C_{gs}$ (5026) is the capacitance of the parasitical capacitor 5026.

Moreover, $$\frac{C_{st}(5014)}{C_T(5022)}(V3 - V4)$$

is the electric potential variation value of the pixel electrode 5022 because of the coupling effect from the scanning line 5002.

The foregoing application of the drive waveform illustrated in FIG. 11 is based on the pixel unit 500 of the third embodiment in FIG. 3. However, it is noticed that the drive waveform illustrated in FIG. 11 also be used in the pixel unit 600 of the fourth embodiment in FIG. 4.

Figure 12:
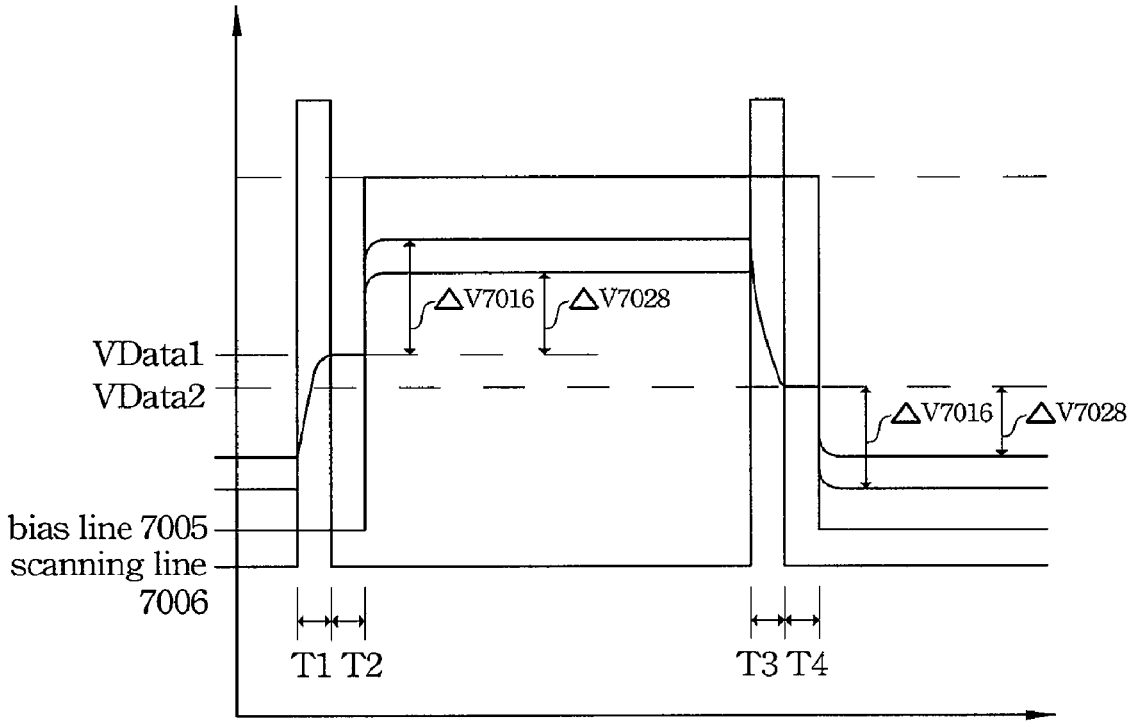
FIG. 12 illustrates a drive waveform and the electric potential change of pixel electrodes according to an embodiment of the present invention.

FIG. 12 illustrates the waveform and the electric potential change of pixel electrodes according to an embodiment of the present invention. Please refer to FIG. 12 and FIG. 5 together. The main different point between the pixel unit 700 of the fifth embodiment and the pixel units 300, 400, 500 and 600 of other embodiments is that the storage capacitors 7014 and 7016 are coupled to the bias line 7002. By the bias signals of the bias line 7002 to separate the electrical potentials of the pixel electrodes 7016 and 7028, the different electrical potentials of the pixel electrode make the transmissive region and the reflective region of the pixel unit 700 have same optical characteristics. In this embodiment, the left part of FIG. 12 illustrates the corresponding waveform in the even frame. The right part of FIG. 12 illustrates the corresponding waveform in the odd frame.

In the odd frame, during the time segment T1 of the odd frame. The electric potential of the scanning line 7006 is pulled up to a high-level electric potential to turn on the thin film transistors 7010 and 7022. The data in the data line 7008 is transferred to the pixel electrode 7016 through the thin film transistor 7010. The data in the data line 7008 is transferred to the pixel electrode 7028 through the thin film transistor 7022. While the end of the time segment T1, the electric potential on the scanning line 7006 is pulled down to a low-level electric potential to turn off the thin film transistor 7010 and 7022. At this time, the pixel electrodes 7016 and 7028 keeps on the voltage value, $V_{data1}$, transferred from the data line.

While the end of the time segment T2, the bias line 7002 is pulled up to a high-level electric potential. The bias line 7002 is coupled to the pixel electrode 7016 through the storage capacitors 7014. The bias line 7002 is coupled to the pixel electrode 7028 through the storage capacitor 7026. Therefore, the electric potentials of the pixel electrodes 7016 and 7028 are affected by the electric potential variation of the bias line 7002. According to this embodiment, the storage capacitor 7014 and the storage capacitor 7026 have different capacitances. Therefore, the pixel electrode 7028 and the pixel electrode 7016 are differently affected by the coupling effect generated by the electric potential change of the bias line 7002. As shown in the FIG. 12, the electric potential change of the pixel electrode 7028 is ΔV(7028) and the electric potential change of the pixel electrode 7016 is ΔV(7016). In other words, by changing the capacitance of the storage capacitor 7014 and 7026, the electric potentials of the pixel electrodes 7016 and 7028 are separated. The different electric potential value between the pixel electrodes 7016 and 7028 makes the transmissive region and the reflective region of the pixel unit 700 have same optics characteristics.

In the even frame, at the starting end of the time segment T3, the scanning line 7006 is pulled up to a high-level electric potential to turn on the thin film transistors 7010 and 7022. The data in the data line 7008 is transferred to the pixel electrode 7016 through the thin film transistor 7010. The data in the data line 7008 is transferred to the pixel electrode 7028 through the thin film transistor 7022. While the end of the time segment T3, the electric potential on the scanning line 7006 is pulled down to a low-level electric potential to turn off the thin film transistors 7010 and 7022. At this time, the pixel electrodes 7016 and 7028 keep on the voltage value, $V_{data2}$, transferred from the data line.

While the end of the time segment T4, the bias line 7002 is pulled down to a low-level electric potential. The bias line 7002 is coupled to the pixel electrode 7016 through the storage capacitors 7014. The bias line 7002 is coupled to the pixel electrode 7028 through the storage capacitor 7026. Therefore, the electric potentials of the pixel electrodes 7016 and 7028 are affected by the electric potential variation of the bias line 7002. According to this embodiment, the storage capacitor 7014 and the storage capacitor 7026 have different capacitances. Therefore, the pixel electrode 7028 and the pixel electrode 7016 are differently affected by the coupling effect generated by the electric potential change of the bias line 7002. As shown in the FIG. 12, the electric potential change of the pixel electrode 7028 is ΔV(7028) and the electric potential change of the pixel electrode 7016 is ΔV(7016). In other words, by changing the capacitance of the storage capacitor 7014 and 7026, the electric potentials of the pixel electrodes 7016 and 7028 are separated. The different electric potential value between the pixel electrodes 7016 and 7028 makes the transmissive region and the reflective region of the pixel unit 700 have same optics characteristics.

Accordingly, a pixel unit in the present invention is divided into two sub-pixels. Each sub-pixel includes a thin film transistor, a liquid crystal capacitor and a storage capacitor. The two sub-pixels with the proposed driving waveform generate different pixel voltage to make the transmissive region and the reflective region of the pixel unit have same optical characteristics. Accordingly, the transmissive region and the reflective region of a pixel unit have same cell gap. Therefore, the process is easy.

As is understood by a person skilled in the art, the foregoing descriptions of the preferred embodiment of the present invention are an illustration of the present invention rather than a limitation thereof. Various modifications and similar arrangements are included within the spirit and scope of the appended claims. The scope of the claims should be accorded to the broadest interpretation so as to encompass all such modifications and similar structures. While a preferred embodiment of the invention has been illustrated and described, it will be appreciated that various changes can be made therein without departing from the spirit and scope of the invention.

What is claimed is:

1. A drive method for driving a pixel unit, wherein a first scanning line and a second scanning line define the pixel unit that includes a first sub-pixel and a second sub-pixel, the first sub-pixel includes a first transistor, a first pixel electrode and a first storage capacitor, the second sub-pixel includes a second transistor, a second pixel electrode and a second storage capacitor, wherein the first transistor and the second transistor couples with the second scanning line, the first pixel electrode couples with the first scanning line through the first capacitor, the second pixel electrode couples with a fix voltage source through the second capacitor and the first sub-pixel located in a reflective region of the pixel unit and the second sub-pixel located in a transmissive region of the pixel unit, comprising:

providing a high level electric potential to the second scanning line to turn on the first transistor and the second transistor to write a data signal transferred from a data line to the first storage capacitor to form a first pixel electrode voltage and to write the data signal to the second storage capacitor to form a second pixel electrode voltage; and providing a low level electric potential to the second scanning line to turn off the first transistor and the second transistor and change the electrical potential of the first scanning line to change the first pixel electrode voltage through the first storage capacitor, wherein an electrical potential of the first pixel electrode is different from an electrical potential of the second pixel electrode.

2. The drive method of claim 1, wherein the data signal is transmitted through the first transistor and the second transistor to write to the second storage capacitor to form the second pixel electrode voltage.

3. The drive method of claim 1, wherein the data signal is transmitted through the second transistor to write to the second storage capacitor to form the second pixel electrode voltage.

4. The drive method of claim 1, wherein the high level electric potential is a first electric potential, the low level electric potential is a second electric potential, and changing the electrical potential of the first scanning line from a third electric potential to the second electrical potential, wherein the first electric potential is larger than second electric potential and second electric potential is larger than third electric potential.

5. The drive method of claim 1, wherein the high level electric potential is a first electric potential, the low level electric potential is a third electric potential, and changing the electrical potential of the first scanning line from a second electric potential to the third electrical potential, wherein the first electric potential is larger than the second electric potential and the second electric potential is larger than the third electric potential.

6. The drive method of claim 1, wherein the high level electric potential is a first electric potential, the low level electric potential is a second electric potential, and changing the electrical potential of the first scanning line from a fourth electric potential to a third electrical potential, wherein the first electric potential is larger than the second electric potential and the second electric potential is larger than the third electric potential and the third electric potential is larger than the fourth electric potential.

7. The drive method of claim 1, wherein the high level electric potential is a first electric potential, the low level electric potential is a fourth electric potential, and changing the electrical potential of the first scanning line from a second electric potential to a third electrical potential, wherein the first electric potential is larger than the second electric potential and the second electric potential is larger than the third electric potential and the third electric potential is larger than the fourth electric potential.

* * * * *